US008153253B2

(12) United States Patent
Yoshimoto et al.

(10) Patent No.: US 8,153,253 B2
(45) **Date of Patent: *Apr. 10, 2012**

(54) CONJUGATE FIBER-CONTAINING YARN

(75) Inventors: Masoto Yoshimoto, Matsuyama (JP); Satoshi Yasui, Osaka (JP); Shigeru Morioka, Matsuyama (JP); Suguru Nakajima, Matsuyama (JP)

(73) Assignee: Teijin Fibers Limited, Osaka (JP)

( * ) Notice: Subject to any disclaimer, the term of this patent is extended or adjusted under 35 U.S.C. 154(b) by 808 days.

This patent is subject to a terminal disclaimer.

(21) Appl. No.: 12/278,373

(22) PCT Filed: Feb. 28, 2007

(86) PCT No.: PCT/JP2007/054366

§ 371 (c)(1),
(2), (4) Date: Aug. 5, 2008

(87) PCT Pub. No.: WO2007/102522

PCT Pub. Date: Sep. 13, 2007

(65) Prior Publication Data

US 2009/0029164 A1 Jan. 29, 2009

(30) Foreign Application Priority Data

| | | |
|---|---|---|
| Mar. 1, 2006 | (JP) | 2006-054684 |
| Mar. 2, 2006 | (JP) | 2006-056425 |
| Mar. 8, 2006 | (JP) | 2006-063174 |
| Mar. 8, 2006 | (JP) | 2006-063175 |
| Mar. 8, 2006 | (JP) | 2006-063176 |

(51) Int. Cl.
*D02G 3/00* (2006.01)

(52) U.S. Cl. ..... 428/370; 428/374

(58) Field of Classification Search ..... 428/370, 428/373, 374

See application file for complete search history.

(56) References Cited

U.S. PATENT DOCUMENTS

| | | | | |
|---|---|---|---|---|
| 3,038,236 | A * | 6/1962 | Breen | 442/200 |
| 3,118,011 | A * | 1/1964 | Breen | 264/168 |
| 4,059,949 | A * | 11/1977 | Lee | 442/311 |
| 5,153,066 | A * | 10/1992 | Tanaka et al. | 428/373 |
| 6,982,118 | B2 * | 1/2006 | Koyanagi et al. | 428/364 |
| 7,654,071 | B2 * | 2/2010 | Yoshimoto et al. | 57/243 |
| 2003/0052436 | A1 * | 3/2003 | Koyanagi et al. | 264/178 R |
| 2008/0132133 | A1 * | 6/2008 | Yasui et al. | 442/200 |
| 2009/0004469 | A1 * | 1/2009 | Yoshimoto et al. | 428/370 |

FOREIGN PATENT DOCUMENTS

| | | | |
|---|---|---|---|
| CN | 1191246 | A | 8/1998 |
| CN | 1392907 | A | 1/2003 |
| CN | 1632205 | A | 6/2005 |
| EP | 0 413 280 | A2 | 2/1991 |
| EP | 0 434 029 | A2 | 6/1991 |
| JP | 4528728 | B | 9/1970 |
| JP | 46847 | B | 1/1971 |
| JP | 4972485 | A | 7/1974 |
| JP | 50116708 | A | 9/1975 |
| JP | 5846118 | A | 3/1983 |
| JP | 5846119 | A | 3/1983 |
| JP | 5-199816 | A | 11/1984 |
| JP | 61-019816 | A | 1/1986 |
| JP | 6119816 | A | 1/1986 |
| JP | 3213518 | A | 9/1991 |
| JP | 03-287820 | A | 12/1991 |
| JP | 9316744 | A | 9/1997 |
| JP | 2003-041462 | A | 2/2003 |
| JP | 2003041444 | A | 2/2003 |
| JP | 200382543 | A | 3/2003 |
| JP | 2003-239141 | A | 8/2003 |
| JP | 2005-023431 | A | 1/2005 |
| WO | 02/22931 | A1 | 3/2002 |
| WO | 2006/041200 | A1 | 4/2006 |

OTHER PUBLICATIONS

Polyester Fiber Manual, p. 305, publication date: May 31, 1991.

* cited by examiner

*Primary Examiner* — N. Edwards
(74) *Attorney, Agent, or Firm* — Sughrue Mion, PLLC

(57) ABSTRACT

A conjugate fiber-containing yarn containing side-by-side or eccentric core-in-sheath conjugate fibers each composed of a polyester component and a polyamide component, that can be crimped by heating, and that has properties of increasing its crimp ratio when it absorbs moisture or water and is excellent in windbreaking and warmth-retaining properties, has a wool-like soft and bulky hand, and is capable of forming a fabric in which a see-through property is not increased even when wetted with water.

8 Claims, No Drawings

CONJUGATE FIBER-CONTAINING YARN

TECHNICAL FIELD

The present invention relates to a conjugate fiber-containing yarn that manifests crimps when heated, and the crimp ratio of which is increased by moisture or water absorption thereof and decreased by drying the filament yarn. The present invention relates in more detail to a conjugate fiber-containing yarn that manifests crimps when heated, the crimp ratio of which is increased by moisture or water absorption thereof and decreased by drying the yarn even after the dyeing and finishing steps, and that is therefore capable of forming a fabric showing a high bulkiness during the time when the fabric is wetted in comparison with the bulkiness during the time when the fabric is dried.

BACKGROUND ART

The background art of the present invention is described in the following references.

[Patent Reference 1] Japanese Examined Patent Publication (Kokoku) No. 45-28728

[Patent Reference 2] Japanese Examined Patent Publication (Kokoku) No. 46-847

[Patent Reference 3] Japanese Unexamined Patent Publication (Kokai) No. 58-46118

[Patent Reference 4] Japanese Unexamined Patent Publication (Kokai) No. 58-46119

[Patent Reference 5] Japanese Unexamined Patent Publication (Kokai) No. 61-19816

[Patent Reference 6] Japanese Unexamined Patent Publication (Kokai) No. 2003-82543

[Patent Reference 7] Japanese Unexamined Patent Publication (Kokai) No. 2003-41444

[Patent Reference 8] Japanese Unexamined Patent Publication (Kokai) No. 2003-41462

[Patent Reference 9] Japanese Unexamined Patent Publication (Kokai) No. 3-213518

[Patent Reference 10] Japanese Unexamined Patent Publication (Kokai) No. 49-72485

[Patent Reference 11] Japanese Unexamined Patent Publication (Kokai) No. 50-116708

[Patent Reference 12] Japanese Unexamined Patent Publication (Kokai) No. 9-316744

It has heretofore been well known that natural fibers such as cotton, wool and feather fibers reversibly change their forms and crimp ratios as humidity changes. Investigations have long been made to make synthetic fibers have such functions. For example, Patent References 1 and 2 have already proposed side-by-side conjugate fibers prepared from a nylon 6 and a modified poly(ethylene terephthalate). Because known conjugate fibers show very small changes in reversible crimp ratios when moisture changes, they have not been put into practical use.

Patent References 3 and 4, and the like, have proposed conjugate fibers prepared under improved heat treatment conditions. Moreover, Patent References 5 to 8, and the like, have proposed conjugate fibers prepared by applying the above conventional technologies. However, the actual situation is that the conjugate fibers obtained by applying the above conventional technologies decrease their crimp ratio changes when subjected to steps, such as dyeing and finishing. As a result, conjugate fibers have not been put into practical use.

In contrast to the above technologies, Patent Reference 9 discloses an attempt to improve the above problems wherein a polyester component and a polyamide component are conjugated in a flat-like state, and a polyamide having a high moisture absorption ratio as a nylon 4 is used as the polyamide component. However, the productivity stability of the nylon 4 is poor, and the crimpability is impaired by heat treatment. Therefore, there is also a restriction on the practical use of such a conjugate fiber.

On the other hand, in addition to the recent problem of ensuring stabilized quality in the yarn productivity and finish texturing, the "see-through" of a fabric prepared from a conjugate fiber has recently become a problem to be solved, among the diversified properties the conjugate fiber is required to have. That is, when a conventional woven or knitted fabric formed from a synthetic fiber or a natural fiber is used for swimwear, sportswear, or the like, the fabric is likely to become "see-through", when wetted with water, and windbreaking and warmth-retaining properties also become poor. Moreover, there is also a demand for a filament yarn and a fabric that has bulkiness and a silk-like touch.

On the other hand, fibers having bulkiness such as a spun yarn have been examined. For example, Patent Reference 10 discloses a method of obtaining a frosty tone fiber by interlacing two types of yarns that have been prepared by spin combining, and heat treating the interlaced yarn. Moreover, Patent Reference 11 discloses a method of spin combining two types of polymers differing from each other in dye-affinity. Furthermore, Patent Reference 12 discloses a method of obtaining a fiber having a moiré tone appearance by combining two types of yarns differing from each other in orientation, in a drawing step so that the dye-affinity difference is utilized. A spun-like woven or knitted fabric having a moiré tone or a frosty tone can be obtained from combined yarns prepared by the above-proposed methods. However, a woven or knitted fabric having a wool-like bulge cannot be obtained. Of course, the above combined yarn has no properties of changing crimps in accordance with the amount of humidity, like wool.

DISCLOSURE OF THE INVENTION

Problems to be Solved by the Invention

The present invention has been achieved while the conventional technologies mentioned above have been taken into consideration. An object of the present invention is to provide a conjugate fiber-containing yarn capable of forming a fabric that has "non-see-through" properties even when wetted with water, that improves windbreaking and warmth-retaining properties due to the narrowing of air gaps, and that stably exhibits these excellent properties even after dyeing, finishing, etc.

Means for Solving the Problems

The conjugate fiber-containing yarn of the present invention comprises a conjugate fiber in which a polyester component and a polyamide component are conjugated in a side-by-side structure or an eccentric core-in-sheath structure, the conjugate fiber yarn being capable of manifesting crimps when heat treated, and the crimp ratio of the crimp-manifested conjugate fiber yarn being increased by moisture or water absorption thereof.

In the conjugate fiber-containing yarn of the present invention, the wet-dry crimp ratio difference ΔC of the conjugate fiber filament yarn represented by the following formula is preferably at least 0.3%

$$\Delta C(\%)=HC(\%)-DC(\%)$$

wherein DC is a dry crimp ratio obtained by subjecting a filament yarn composed of the conjugate fiber to a boiling water treatment for 30 minutes to manifest crimps, heat treating the treated yarn at 100° C. for 30 minutes under a load of $1.76\times10^{-3}$ CN/dtex to stabilize the crimps, heat treating the crimped conjugate fiber at 160° C. for 1 minute under a load of $1.76\times10^{-3}$ CN/dtex and measuring the crimp ratio, and HC is a wet crimp ratio obtained by immersing the crimped conjugate fiber having the dry crimp ratio DC in water at a temperature of from 20 to 30° C. for 10 hours, and measuring the crimp ratio.

In the conjugate fiber-containing yarn of the present invention, the polyester component preferably comprises a modified polyester in which 5-sodiumsulfoisophthalic acid is copolymerized in an amount of from 2.0 to 4.5% by mole based on a total molecular amount of the acid component, and the intrinsic viscosity IV of the polyester component is preferably from 0.30 to 0.43.

In the conjugate fiber-containing yarn of the present invention, the dry crimp ratio DC is preferably from 0.2 to 6.7%, and the wet crimp ratio HC is preferably from 0.5 to 7.0%.

In the conjugate fiber-containing yarn of the present invention, the conjugate fiber yarn may be formed from a thick and thin conjugate fiber in which a thick portion and a thin portion are alternately distributed along the longitudinal direction.

In the conjugate fiber-containing yarn of the present invention, the dry crimp ratio DC of the thick and thin conjugate fiber filament yarn is preferably from 4.0 to 12.7%, and the wet crimp ratio HC thereof is from 4.3 to 13.0%.

In the conjugate fiber-containing yarn of the present invention, the U % of the thick and thin conjugate fiber yarn is preferably from 2.5 to 15.0%.

In the conjugate fiber-containing yarn of the present invention, a yarn formed from conjugate fibers and a filament yarn formed from at least one type of fibers having a boiling water shrinkage higher than that of the conjugate fiber may be doubled and combined together, and the conjugate fibers and the higher shrinkage fibers may be mixed with each other.

In the conjugate fiber-containing yarn of the present invention, the boiling water shrinkage (BWSB) of the yarn formed from the conjugate fibers in the doubled combined fiber yarn is preferably from 12 to 30%, the boiling water shrinkage (BWSA) of the higher shrinkage fiber yarn is preferably 40% or less, and the difference between both the shrinkages: (BWSA)−(BWSB) is preferably from 10 to 26%.

In an embodiment of the conjugate fiber-containing yarn of the present invention, the conjugate fiber-containing yarn is a core-in-sheath composite false twist textured yarn (1) obtained by false twist texturing composite yarns each prepared from a sheath yarn that is a filament yarn formed from the conjugate fibers and a core yarn that is a yarn different from the sheath yarn, and the core-in-sheath composite false twist textured yarn has a yarn length difference of from 5 to 20% calculated from the following formula:

$$\text{yarn length difference}=(La-Lb)/La\times100(\%)$$

wherein La (sheath portion yarn length) and Lb (core portion yarn length) are determined by the following procedure:
a sample 50 cm long is taken from the core-in-sheath composite false twist textured yarn; a load of 0.176 cN/dtex (0.2 g/de) is applied to one end of the sample, and the sample is vertically suspended; marks are made at 5 cm intervals on the sample; the load is removed, and the marked portions are cut to give 10 sample pieces for measurement; one individual filament is taken out of the sheath portion of each sample piece, and one individual filament is taken out of the core portion thereof to give 10 individual filaments of the sheath portions and 10 individual filaments of the core portions; a load of 0.03 cN/dtex (1/30 g/de) is applied to one end of each individual filament, and the filament is vertically suspended; the length of each filament is measured; the average value of the 10 filaments in the sheath portions is defined as a sheath portion yarn length and designated by La, and the average value of the 10 filaments in the core portions is defined as a core portion yarn length and designated by Lb.

In an embodiment of the conjugate fiber-containing yarn of the present invention, the conjugate fiber-containing yarn is a false twist textured yarn (2) obtained by false twist texturing the conjugate fiber-containing yarn mentioned above, and the crimp ratio of the textured yarn increases when the textured yarn absorbs moisture or water.

In the conjugate fiber-containing filament yarn of the present invention, the conjugate fiber false twist textured yarn preferably has a dry crimp ratio TDC of 5.0 to 23.7%, determined by subjecting the conjugate fiber-containing filament yarn having been false twist textured, to boiling water treatment for 30 minutes, subjecting the resultant yarn to dry heat treatment at 100° C. for 30 minutes under a load of $1.76\times10^{-3}$ CN/dtex, and further subjecting the resultant yarn to dry heat treatment at 160° C. for 1 minute under a load of $1.76\times10^{-3}$ CN/dtex; the wet crimp ratio THC of the conjugate fiber false twist textured yarn is preferably 4.7 to 24%, determined after immersing the conjugate fiber false twist textured yarn in water at temperatures of 20 to 30° C. for 10 minutes; and the differential crimp ratio ΔTC that is a difference represented by the formula: (THC)−(TDC) is from 0.3 to 8.0%.

Effect of the Invention

The conjugate fiber contained in the conjugate fiber-containing yarn can manifest crimps when heat treated. The conjugate fiber has properties of increasing the crimp ratio when it absorbs moisture or water, and decreasing the crimp ratio when it is dried. As a result, a woven or knitted fabric prepared from the conjugate fiber-containing yarn of the invention has properties of not strengthening its see-through properties when it absorbs moisture or water. Moreover, the fabric is excellent in windbreaking and warmth-retaining properties, and the properties never change even when the fabric is subjected to processing such as dyeing and finishing. The conjugate fiber-containing yarn of the present invention is therefore useful as a raw material for fiber products such as clothing.

BEST MODE FOR CARRYING OUT THE INVENTION

In the conjugate fiber contained in the conjugate fiber-containing yarn of the present invention, a polyester component composed of a polyester resin and a polyamide component composed of a polyamide resin are conjugated in a side-by-side structure or an eccentric core-in-sheath structure. The conjugate fiber can manifest crimps when heat treated. The crimped conjugate fiber having manifested the crimps has the properties of increasing the crimp ratio when it absorbs moisture or water.

Examples of the polyester component forming the conjugate fiber of the present invention include a poly(ethylene terephthalate), a poly(trimethylene terephthalate) and a poly (butylene terephthalate). Of these, a poly(ethylene terephthalate) is preferred in view of the cost and general-purpose properties.

In the present invention, the above polyester component is preferably a modified polyester in which 5-sodiumsulfoisophthalic acid is copolymerized. When the copolymerization amount of 5-sodiumsulfoisophthalic acid is excessive, excellent crimpability cannot be obtained, although separation of the polyamide component and the polyester component at the conjugated boundary hardly takes place. Moreover, in order to improve crimpability, crystallization has to be promoted. However, raising the draw-heat treatment temperature for the purpose of promoting crystallization is not preferred in view of yarn productivity, because yarn breakages are likely to take place. Conversely, when the copolymerization amount is too small, separation of the polyamide component and the polyester component at the conjugated boundary unpreferably tends to take place, although crystallization of the polyester component is likely to proceed during draw-heat treatment and excellent crimpability is obtained. The copolymerization amount of 5-sodiosulfoisophthalic acid is therefore preferably from 2.0 to 4.5% by molar amount, more preferably from 2.3 to 3.5% by molar amount.

Moreover, an excessively low intrinsic viscosity of the polyester component is not preferred in view of the industrial production and quality of the conjugate fiber, because the fiber productivity is lowered and at the same time fluffs tend to be generated. Conversely, when the intrinsic viscosity is excessively high, fluffs are likely to be generated and yarn breakage tends to take place due to poor spinnability and drawability of the polyester component side caused by the thickening action of the copolymerized 5-sodiumsulfoisophthalic acid. The intrinsic viscosity of the polyester component is therefore preferably from 0.30 to 0.43, more preferably from 0.35 to 0.41.

On the other hand, there is no specific restriction on the polyamide component as long as the polyamide component has an amide bond in the principal chain. Examples of the polyamide component include nylon 4, nylon 6, nylon 66, nylon 46 and nylon 12. Of these polymers, nylon 6 and nylon 66 are preferred in view of the fiber production stability and general-purpose properties. Moreover, the polyamide component may contain another copolymerized component while such a polyamide as mentioned above is used as a base component.

Furthermore, both components explained above, may each contain conventional pigments such as titanium oxide and carbon black, conventional antioxidants, antistatic agents, light-resistant agents, etc.

The conjugate fiber for the present invention is one that has a fiber cross-sectional shape in which the above polyester component and the above polyamide component are conjugated together. A preferred conjugation form of the polyamide component and the polyester component is one in which both components are conjugated in a side-by-side manner, in view of the crimp manifestation. The cross-sectional shape of the above conjugate fiber may be either a circular or noncircular cross section. A triangular cross section, a quadrangular cross section, or the like cross section may be employed as the noncircular one. In addition, the presence of hollow portions within the cross section of the conjugate fiber does not matter.

Furthermore, the ratio of the polyester component to the polyamide component on the basis of the area in the fiber cross section is as follows: a polyester component/polyamide component ratio is preferably from 30/70 to 70/30, more preferably from 60/40 to 40/60.

When the conjugate fiber-containing yarn of the invention is a filament yarn composed of a conjugate fiber (filament yarn composed of 100% of a conjugate fiber), the wet-dry crimp ratio difference ΔC of the conjugate fiber represented by the following equation is preferably at least 0.3%, more preferably from 0.3 to 130%, still more preferably from 0.3 to 6.8%

$$\Delta C(\%)=HC(\%)-DC(\%)$$

wherein DC is a dry crimp ratio obtained by subjecting the filament yarn composed of the conjugate fiber to a boiling water treatment for 30 minutes to manifest crimps, heat treating the treated yarn at 100° C. for 30 minutes under a load of $1.76\times10^{-3}$ CN/dtex to stabilize the crimps, heat treating the crimped conjugate fiber at 160° C. for 1 minute under a load of $1.76\times10^{-3}$ CN/dtex and measuring the crimp ratio, and HC is a wet crimp ratio obtained by immersing the crimped conjugate fiber having the dry crimp ratio DC in water at a temperature of from 20 to 30° C. for 10 hours, and measuring the crimp ratio. A fabric such as a woven or knitted fabric prepared from a filament yarn containing a conjugate fiber having such crimping properties has the following advantages: even when the fabric is wetted with water, the see-through properties are not strengthened because the crimp ratio of the conjugate fiber is increased by moisture or water absorption of the conjugate fiber contained therein, and the air gap portions of the fabric are narrowed to improve the windbreaking and warmth-retaining properties. The properties are not deteriorated even after the fabric is subjected to processing steps such as dyeing and finishing.

When the conjugate fiber yarn is a draw yarn (thick and thin conjugate fiber to be described later being excluded), the dry crimp ratio DC is preferably from 0.2 to 6.7%, more preferably from 0.2 to 3.0%, still more preferably from 0.3 to 2.5%, most preferably from 0.4 to 2.3%. When the crimp ratio DC is less than 0.2%, the filament yarn thus obtained becomes flat, and the fabric prepared therefrom has a poor feeling. On the other hand, when the crimp ratio DC exceeds 6.7%, the crimp ratio DC exceeds the crimp ratio HC after water immersion. As a result, making the fabric hardly see-through even when the fabric is wetted, that is an object of the invention, becomes impossible sometimes. Moreover, because the stitches of the fabric are widely opened and the air gaps become large, a fabric excellent in windbreaking and warmth-retaining properties cannot be obtained sometimes.

The wet crimp ratio HC after immersion in water is preferably from 0.5 to 7.0%, more preferably from 0.8 to 6.5%, still more preferably from 1.0 to 6.0%. When HC is less than 0.5%, the crimp ratio itself after water immersion becomes too low, and the effects of preventing see-through, the windbreaking properties and warmth-retaining properties that are desired become unsatisfactory sometimes. On the other hand, when HC exceeds 7.0%, the fabric containing water greatly shrinks. The fabric therefore becomes nonpractical, and the feeling becomes poor sometimes.

The difference ΔC between HC and DC is preferably in the range of from 0.3 to 6.8%, more preferably from 0.7 to 5.5%, still more preferably from 0.8 to 5.0%. When ΔC is less than 0.3%, the effect of increasing the crimp ratio after water immersion becomes insignificant, and the desired fabric that is hardly see-through even when the fabric is wetted with water, and that is excellent in waterproof and warmth-retaining properties cannot be obtained sometimes. On the other hand, when ΔC exceeds 6.8%, the fabric nonpractically shrinks greatly when it contains water, and the feeling becomes poor sometimes.

For the above conjugate fiber, the polyester component and the polyamide component may be conjugated in a side-by-side manner. Moreover, when the above two components form an eccentric core-in-sheath structure, it is preferred that the core portion is formed from a polyester component and the sheath portion is formed from a polyamide component. In general, when the conjugate fiber used in the present invention manifests crimps at the time of being heat treated, it is preferred that the polyester component is located inside the curved portion of the crimped conjugate fiber and the polyamide component is situated outside the curved one. In order to make the conjugate fiber manifest crimps in such a manner, it is necessary that the thermal shrinkage of the polyester component in the non-crimped conjugate fiber must be greater than that of the polyamide component, and that the water absorption elongation of the polyamide component in the conjugate fiber after crimping must be greater than that of the polyester component. When the above conditions are satisfied, the following results are obtained. The polyamide component (outside the curvature) extends more than the polyester component (inside the curvature) when the crimped conjugate fiber absorbs moisture or water, and as a result the crimp ratio increases.

The above crimp ratio signifies the ratio (%) of a difference between the length of a crimped fiber the crimp of which is elongated and the apparent length of the crimped fiber to the above length of the crimped fiber the crimp of which is elongated.

Thermal shrinkage signifies the ratio (%) of a difference obtained by subtracting the length of a sample after heat treatment from that of the sample before heat treatment to the above length before heat treatment.

Water absorption elongation signifies the ratio (%) of a difference obtained by subtracting the length of a sample before water absorption from that of the sample after water absorption to the length before water absorption. When water absorption elongation is positive, the fiber shows that it has extended after water absorption. When water absorption elongation is negative, the fiber shows that it has shrunk after water absorption.

In order to impart the crimpability mentioned above to the conjugate fiber of the present invention, both the polyester component and the polyamide component forming the conjugate fiber must each have appropriate crystallinity. When crystallinity is too high, the crimpability, thermal shrinkage and water absorption elongation mentioned above become insufficient sometimes. When crystallinity is too low, tensile strength becomes insufficient, and the conjugate fiber is likely to be broken in the heating and drawing step. As a result, the drawability of the conjugate fiber becomes insufficient sometimes.

The individual fiber thickness of the conjugate fiber used in the yarn of the present invention and the total thickness of the conjugate fiber-containing yarn should be suitably determined in accordance with the applications. For example, when these are used for conventional clothing materials, the individual fiber thickness of the conjugate fiber is preferably from 1 to 6 dtex, and the total thickness of the conjugate fiber-containing filament yarn is preferably from 40 to 200 dtex.

The conjugate fiber-containing yarn of the present invention may be interlaced so that constituent fibers are mutually interlaced.

In order to produce the conjugate fiber for the yarn of the present invention, the following procedure is carried out as disclosed in, for example, Japanese Unexamined Patent Publication (Kokai) No. 2000-144518. Using a spinneret wherein an extrusion orifice on the high viscosity side and one on the low viscosity side are separated, and the extrusion linear speed on the high viscosity side is made small (extrusion cross-sectional area is made large), a molten polyester is passed through the extrusion orifice on the high viscosity side; a molten polyamide is passed through the extrusion orifice on the low viscosity side; a molten polymer flow extruded from the extrusion orifice for the high viscosity component and one extruded from the extrusion orifice for the low viscosity component are conjugated or combined in a side-by-side manner or in an eccentric core-in-sheath manner; the conjugate flow of the polymer molten body thus formed is cooled and solidified.

The undrawn conjugate fiber taken up from the above melt spinning apparatus may be wound once, unwound, drawn, and optionally heat treated. Alternatively, the undrawn fiber is directly drawn without winding the undrawn fiber, and heat treated simultaneously or after drawing.

In the production of the conjugate fiber for the yarn of the present invention, the melt spinning rate is preferably from 800 to 3,500 m/min, more preferably from 1,000 to 2,500 m/min. Moreover, in order to draw the undrawn fiber, a drawing machine that draws the undrawn fiber between two rollers is used. The undrawn conjugate fiber formed by the melt spinning apparatus may be directly drawn (without winding), and optionally heat treated simultaneously with drawing. The undrawn conjugate fiber supplied is preheated at a temperature from 50 to 100° C. by a first roller on the yarn feeding side of the drawing machine. The preheated conjugate fiber may be drawn between the first roller and a second roller for sending, and heat treated by the second roller heated at temperature of from 80 to 170° C., preferably from 80 to 140° C. The draw ratio between the first roller and the second roller may be determined so that desired heat crimp manifesting properties are imparted to the conjugate fiber. For example, the draw ratio is preferably from 1.2 to 3.0, more preferably from 1.5 to 2.9.

In order to manifest crimps in the conjugate fiber for the filament yarn of the present invention, the conjugate fiber (non-crimped) is heated so that crimps are manifested. For example, when crimps are manifested by treating the non-crimped conjugate fiber in boiling water for, for example, 30 minutes, the polyester component is located inside the curved portion of the crimped fiber, and the polyamide component is located outside. The polyamide component in the crimped fiber is in a state of absorbing water. The plasticizing effect of water elongates the polyamide component in a period of time. As a result, the crimped state of the crimped fiber changes with time. That is, the crimped state is unstable. The crimped fiber is therefore subjected to a dry heat treatment so that moisture is removed and the crimped state of the crimped conjugate fiber is stabilized. In order to carry out the drying, the conjugate fiber is, for example, subjected to a dry heat treatment at 100° C. for 30 minutes, and preferably further subjected thereto at 160° C. for 1 minute.

As explained above, when the conjugate fiber is subjected to boiling water treatment (for 30 minutes), drying (at 100° C. for 30 minutes) and finish drying (at 160° C. for 1 minute), the crimps manifested in the conjugate fiber are stabilized. Even when the conjugate fiber the crimps of which have been stabilized is conventionally heat treated, no significant change in the crimping properties takes place.

The conjugate fiber-containing yarn of the invention may be formed from the above conjugate fiber alone. Alternatively, the above conjugate fiber yarn may be doubled with a yarn different from the conjugate fiber yarn, and both yarns may be combined to give the conjugate fiber-containing yarn of the invention. Moreover, the conjugate fiber-containing yarn may optionally be a conjugate fiber-containing false twist textured yarn obtained by false twist texturing. Alternatively, the conjugate fiber-containing yarn of the invention may also be a conjugate fiber-containing false twist textured yarn obtained by composite false twist texturing a yarn formed from the above conjugate fiber alone with a filament yarn formed from a fiber (that may also be a conjugate fiber) different from the conjugate filament yarn in the elongation at break.

The above conjugate fiber-containing yarn of the present invention can be used for various clothing applications. For example, when yarn is used for applications where moisture and water absorption takes place, namely, when it is used for swimwear and other sportswear, underwear, uniforms, and the like, they can exhibit excellent comfortableness during wearing because they prevent see-through when wet and are excellent in windbreaking and warmth-retaining properties.

The above conjugate fiber-containing yarn of the invention may also be used in combination with a natural fiber yarn, or may also be used in combination with a polyurethane or poly(trimethylene terephthalate) fiber yarn and used for applications of a stretch fiber yarn or fabric.

The conjugate fiber-containing yarn of the present invention includes, as one embodiment, a yarn that contains a thick and thin conjugate fiber in which thick portions and thin portions are alternately distributed in the longitudinal direction.

When a fabric such as a woven or knitted fabric is produced from yarn containing crimped thick and thin conjugate fibers produced by heat treating, such a thick and thin conjugate fibers, the fabric prepared from the crimped thick and thin conjugate fiber-containing yarn can prevent the strengthening of the see-through properties of the fabric at the time of wetting the fabric with water, particularly because the alternate distribution of a thick portion and a thin portion in the thick and thin conjugate fiber promotes an increase in the crimp ratio caused by moisture and water absorption.

That is, the dry crimp ratio DC of the yarn formed from the above thick and thin conjugate fiber is preferably from 4.0 to 12.7%, more preferably from 4.0 to 12.0%, still more preferably from 4.5 to 10.0%, further preferably from 5.0 to 8.5%. When the crimp ratio DC mentioned above is less than 4.0%, a fabric prepared therefrom tends to have a poor feeling. On the other hand, when the crimp ratio DC mentioned above exceeds 12.7%, the crimp ratio DC is likely to exceed the crimp ratio HC after water immersion. As a result, the prevention of see-through is deteriorated and the windbreaking and warmth-retaining properties sometimes become insufficient because the air gaps of the fabric are narrowed.

Furthermore, the wet crimp ratio HC after immersion in water is preferably from 4.3 to 13.0%, more preferably from 5.0 to 13.0%, still more preferably from 5.5 to 11.0%, further preferably from 6.0 to 10.5%. When the crimp ratio is less than 4.3%, the crimp ratio after immersion in water becomes excessively low. As a result, the desired effect of preventing see-through and improving windbreaking and warmth-retaining properties sometimes become insufficient. On the other hand, when the crimp ratio HC exceeds 13.0%, the fabric greatly shrinks nonpractically sometimes at the time of its containing water, and the feeling becomes poor sometimes.

Furthermore, a difference ΔC between HC and DC mentioned above is preferably from 0.3 to 8.0%, more preferably from 1.0 to 5.5%, still more preferably from 1.5 to 4.5%. When ΔC is less than 0.3%, the effect of increasing the crimp ratio after water immersion is insignificant, and a fabric that is hardly see-through when wetted with water, and that shows improved windbreaking and warmth-retaining properties due to narrowed air gaps, cannot be obtained sometimes. On the other hand, when ΔC exceeds 8.0%, the fabric greatly shrinks when it becomes wet, which is not practical, and the feeling can become poor.

The thick and thin conjugate fiber-containing yarn of the present invention is excellent in not only function, but also feeling. That is, because the conjugate fiber of the invention has thick portions and thin portions in the longitudinal direction, a fabric prepared from a filament yarn containing the conjugate fiber presents a spun yarn-like hand. Moreover, in the present invention, U % that shows a degree of thickness and thinness of the conjugate fiber is preferably from 2.5 to 15.0%, more preferably from 3.5 to 14.5%, still more preferably from 4.0 to 13.5%. When U % is less than 2.5%, a fabric prepared from the conjugate fiber does not preferably have a no spun-like feeling, and the properties of preventing see-through at the time when the fabric absorbs moisture are likely to be deteriorated. On the other hand, when U % exceeds 15%, the strength of the conjugate fiber is lowered, and the handleability unpreferably becomes difficult.

U % is a parameter representing a fluctuation or unevenness in the thickness of the yarn, and is calculated from the formula $$U\%=f/F\times 100$$

wherein F represents an area calculated from an average thickness and a length L of the sample yarn, and f represents a total area between a yarn thickness fluctuation curve that is measured with a yarn thickness fluctuation tester (Uster) and a line showing an average thickness.

The thick and thin conjugate fiber yarn of the invention having a total fiber thickness of from 40 to 200 dtex and an individual fiber thickness of from 1 to 6 dtex can be used as conventional clothing materials. In addition, the filament yarn may optionally be interlaced.

In order to produce the thick and thin conjugate fiber yarn of the present invention, a spinneret (as disclosed in Japanese Unexamined Patent Publication (Kokai) No. 2000-144518) wherein the extrusion orifice on the high viscosity component side and the extrusion orifice on the low viscosity component side are separated, and the linear extrusion speed on the high viscosity side is made small (extrusion cross-sectional area is enlarged), is used; a molten polyester is passed through the extrusion orifice on the high viscosity side, and a molten polyamide is passed through the extrusion orifices on the low viscosity side, followed by conjugating the polyester and the polyamide and cooling and solidifying the conjugated body. The melt-spun filament yarn thus taken up can be drawn by the following procedures: the filament yarn is subjected to separate drawing wherein the filament yarn is wound once, then drawn, and optionally heat treated; or the filament yarn is subjected to direct drawing wherein the filament yarn is drawn without winding, and optionally heat treated. A relatively low rate of from 800 to 3,500 m/min is preferably employed as the spinning rate. Moreover, for example, when the melt-spun filament yarn is direct drawn and heat set by direct drawing with a drawing machine in which two rollers are installed, the filament yarn is preferably preheated at a first roller temperature of less than 60° C. When the preheating temperature exceeds 60° C., the desired thick and thin filament yarn is difficult to obtain. Next, the filament yarn is heat set at a second roller temperature of preferably from 80 to 170° C., more preferably from 80 to 140° C. Moreover, the ratio of drawing conducted between the first roller and the second roller should be determined while the degree of thickness and thinness is taken into consideration. For example, the thick and thin conjugate fiber yarn of the invention can be easily obtained by drawing at a draw ratio as low as at least 55% of the elongation at break of the undrawn conjugate fiber yarn.

In order to manifest crimps in the thick and thin conjugate filament yarn of the present invention, the filament yarn is first boiling water treated, whereby crimps in which the polyester component is arranged inside each crimp are obtained. However, because the filament yarn in such a state contains moisture, the polyamide is extended by the plasticizing effect of water. As a result, the crimps themselves change with time and become unstable. The filament yarn having been crimped by boiling water is therefore subjected to a dry heat treatment so that moisture is removed and the crimps are stabilized. In order to stabilize the crimping properties, for example, the conjugate fiber such as explained above is boiling water treated for 30 minutes, dry heat treated further at 100° C. for 30 minutes to manifest crimps, and then dry heat treated at 160° C. for 1 minute. When the fabric prepared from the thick and thin conjugate fiber-containing yarn in which the crimps are thus stabilized is heat treated in the conventionally conducted finishing step, a fabric having the desired properties can be obtained.

The thick and thin conjugate fiber of the invention can naturally be used singly. Moreover, the conjugate fiber can be used as a combined filament yarn by combining the conjugate fiber with another fiber. Furthermore, the combined filament yarn is optionally false twist textured further, and can be used as a false twist textured yarn. It can also be used as a composite false twist textured yarn having different elongations.

The thick and thin conjugate fiber yarn of the present invention can be used for various applications for clothing. For example, it can be particularly and preferably used for such applications that require comfortableness, in clothing such as swimwear and various sportswear, underwear materials and uniforms.

Compositing the thick and thin conjugate fiber and a natural fiber can naturally still further exhibit the effect. Moreover, stretchability may also be further imparted by a combination of urethane or poly(trimethylene terephthalate) filament yarn.

The conjugate fiber-containing yarn of the present invention include, as one embodiment, a conjugate fiber-containing combined filament yarn wherein the yarn composed of the above conjugate fiber and a yarn composed of at least one type of fibers having a shrinkage in boiling water higher than that of the conjugate fiber are doubled and combined with each other.

The conjugate fiber-containing combined filament yarn of the above embodiment has properties of "non-see-through" even when wetted with water, and the wetted yarn exhibits excellent windbreaking and warmth-retaining properties. That is, the above combined filament yarn not only has a bulge feel, a silky touch and excellent feeling, but also shows effects produced by a new function, which a conventional individual filament yarn and conventional combined filament yarn do not have.

A higher shrinkage (BWSA) of the high shrinkage fiber in boiling water is more desirable in order to make the fiber have a bulge, however, BWSA is preferably 40% or less.

When the shrinkage (BWSA) exceeds 40%, a woven or knitted fabric obtained from the high shrinkage fiber tends to have a stiff feeling. Moreover, the shrinkage (BWSB) of the conjugate fiber in boiling water is preferably from 12 to 30%, more preferably from 13 to 28%, still more preferably from 14 to 26%. When the shrinkage (BWSB) of the conjugate fiber in boiling water is less than 12%, the temperature for the heat treatment for lowering the shrinkage must be raised. The yarn breakage then does not preferably increase during the production of the combined filament yarn. On the other hand, when the shrinkage (BWSB) of the conjugate fiber in boiling water exceeds 30%, the feeling becomes coarse and rough.

Furthermore, the difference between the shrinkage (BWSA) of the high shrinkage fiber and the shrinkage (BWSB) of the conjugate fiber: (BWSA−BWSB)=ΔBWS, is preferably from 10 to 26%, more preferably from 12 to 24%, still more preferably from 14 to 22%. When ΔBWS is less than 10%, a woven or knitted fabric that is bulge is likely to be hardly obtained. On the other hand, when ΔBWS exceeds 26%, a fabric having a silky touch is not easily obtained. Moreover, because the shrinkage of the conjugate fiber is lowered during the production of the fabric, yarn breakage often takes place.

The conjugate fiber in the combined filament yarn of the present invention has filaments that increase the crimp ratio when they absorb moisture or water. The present inventors have discovered that a fabric prepared from a combined filament yarn having such a structure does not become "see-through" even when wetted with water, and that the fabric is then excellent in windbreaking and warmth-retaining properties, because the stitches are clogged. The fabric also has a bulge feel even when wetted with water.

The conjugate fiber filament yarn used in the conjugate fiber-containing combined filament yarn of the invention shows a wet-dry crimp ratio difference ΔC of the following formula of preferably from 0.5 to 5.0%, more preferably from 0.8 to 6.0%

$$\Delta C(\%)=HC(\%)-DC(\%)$$

wherein DC is a dry crimp ratio obtained by subjecting a yarn composed of the conjugate fiber to a boiling water treatment for 30 minutes to manifest crimps, heat treating (drying) the treated yarn at 100° C. for 30 minutes to stabilize the crimps, dry heat treating the crimped conjugate fiber at 160° C. for 1 minute and measuring the crimp ratio, and HC is a wet crimp ratio obtained by immersing the crimped conjugate fiber having the dry crimp ratio DC in water at a temperature of from 20 to 30° C., and measuring the crimp ratio. When ΔC is less than 0.5%, the effect of increasing a crimp ratio (improving see-through prevention and windbreaking and warmth-retaining properties) produced by moisture or water absorption becomes inadequate. Moreover, when ΔC exceeds 5.0%, the shrinkage of the combined filament yarn or the fabric prepared therefrom sometimes becomes excessively high at the time of moisture or water absorption of the yarn or fabric, to impair the feeling.

The combined filament yarn is produced by the method as explained below. A high shrinkage fiber filament yarn and a conjugate fiber yarn are produced separately. The high shrinkage fiber yarn and the conjugate fiber yarn thus obtained are doubled, and the doubled yarn is fed to a fiber interlacing machine, such as an air interlacing machine where an air jet is blown to the yarn to combine the filament yarn.

Examples of the high shrinkage fiber yarn include a high shrinkage fiber formed from a single polyester polymer, a high shrinkage conjugate fiber (having the same conjugate structure as that of the conjugate fiber used as a low shrinkage component), a high shrinkage conjugate fiber formed from a poly(ethylene terephthalate) and a poly(trimethylene terephthalate) and a high shrinkage conjugate fiber formed from a poly(ethylene terephthalate) and a poly(butylene terephthalate). Use of a high shrinkage fiber formed from a single polyester polymer is preferred in view of cost. Examples of such a single polyester polymer fiber include a high shrinkage fiber formed from a poly(ethylene terephthalate), a poly(trimethylene terephthalate) or a poly(butylene terephthalate).

Of these high shrinkage fibers, a poly(ethylene terephthalate) fiber is preferably used in view of cost.

When the above combined filament yarn is used for conventional clothing materials, the total fiber thickness is preferably from 40 to 200 dtex, and the individual fiber thickness of the high shrinkage fiber and that of the conjugate fiber are each preferably from 1 to 6 dtex.

The above combined filament yarn can be used singly, or it can be further combined or composited with other fibers, and used. The other fibers may be natural fibers, or the filament yarn may be used in combination with a urethane fiber and a poly(trimethylene terephthalate) fiber so that stretchability is imparted to the resultant yarn.

The composite false twist textured yarn of the present invention can be used for various clothing applications. For example, when the yarn is used for such various applications required to have comfortableness such as the prevention of see-through, and windbreaking and warmth-retaining properties in clothing such as sportswear, underwear materials and uniforms, the yarn can be particularly preferably used.

The conjugate fiber-containing yarn of the present invention includes, as one embodiment, a core-in-sheath composite false twist textured yarn obtained by false twist texturing a composite yarn prepared from a yarn composed of the conjugate fibers as a sheath yarn and a yarn different from the sheath yarn as a core yarn. The core-in-sheath composite false twist textured yarn preferably shows a yarn length difference calculated from the following formula of from 5 to 20%

$$\text{yarn length difference}=(La-Lb)/La\times 100(\%)$$

wherein La (sheath portion yarn length) and Lb (core portion yarn length) are determined by the following procedure:
a sample 50 cm long is taken from the core-in-sheath composite false twist textured yarn; a load of 0.176 cN/dtex (0.2 g/de) is applied to one end of the sample, and the sample is vertically suspended; marks are made at 5 cm intervals on the sample; the load is removed, and the marked portions are cut to give 10 sample pieces for measurement; one individual filament is taken out of the sheath portion of each sample piece, and one individual filament is taken out of the core portion thereof to give 10 individual filaments of the sheath portions and 10 individual filaments of the core portions; a load of 0.03 cN/dtex (1/30 g/de) is applied to one end of each individual filament, and the filament is vertically suspended; the length of each filament is measured; the average value of the 10 filaments in the sheath portions is defined as a sheath portion yarn length and designated by La, and the average value of the 10 filaments in the core portions is defined as a core portion yarn length and designated by Lb.

The above conjugate fiber-containing core-in-sheath composite false twist textured yarn has the properties that even when the yarn is wetted with water, the yarn is "non-see-through". Moreover, the yarn exhibits windbreaking and warmth-retaining properties. That is, the composite false twist textured yarn is spun yarn-like, has a bulge feel, and is excellent in a soft hand. Moreover, the yarn shows effects produced by new functions that conventional composite false twist textured yarns have never had.

The above conjugate fiber-containing core-in-sheath composite false twist textured yarn is formed from a sheath yarn and a core yarn. As a result, the composite yarn has a bulge feel like a wool spun yarn, and can show a soft feeling.

It is preferred that there is a difference in the average yarn length between a fiber forming the sheath yarn and a fiber forming the core yarn. That is, the average yarn length of a fiber forming the sheath yarn is longer than that of a fiber forming the core yarn preferably by 5 to 20%, more preferably by 8 to 15%. During composite false twist texturing, the fiber forming the sheath yarn is principally arranged in the sheath portion of the composite false twist textured yarn, and the fiber forming the core yarn is principally arranged in the core portion thereof. As a result, a finer feeling can be manifested. Moreover, the handleability during weaving or knitting is improved, and a fabric having a softer feeling is obtained. A yarn length difference between the fiber forming the sheath yarn and the fiber forming the core yarn of less than 5% is not preferred because the fabric obtained from the textured yarn hardly has a spun yarn-like feeling. On the other hand, a yarn length exceeding 20% is not preferred, because the fabric obtained therefrom is likely to have a soft and fluffy feeling and yarn breakage often takes place during false twist texturing.

For the above composite false twist textured yarn, it is important that the sheath yarn is formed from conjugate fibers that increase the crimp ratio when it absorbs moisture or water. The present inventors have found that a fabric prepared from the composite false twist textured yarn as explained above, does not become "see-through" even when wetted with water, and is excellent in windbreaking and warmth-retaining properties because the stitches of the fabric are clogged. The fabric has a bulge feel even when wetted with water.

The conjugate fiber that is used as a sheath yarn of the above composite false twist textured yarn and that increases the crimp ratio when it absorbs moisture or water is a side-by-side or eccentric core-in-sheath conjugate fiber having a fiber cross-sectional shape in which a polyester component and a polyamide component are conjugated.

In order for the above conjugate fiber-containing core-in-sheath composite false twist textured yarn to have a spun yarn-like hand and properties of increasing the crimp ratio when it absorbs water or moisture, the elongation at break of the sheath yarn is preferably from 60 to 350%, more preferably from 100 to 300%. When the elongation at break of the sheath yarn exceeds 350%, the textured yarn has the following drawbacks: the yarn length difference between the sheath yarn and the core yarn is likely to exceed 20%; the hand is likely to become unsatisfactory, and the yarn breakage is likely to take place many times during composite false twist texturing. On the other hand, when the elongation at break of the sheath yarn is less than 60%, the textured yarn has the following drawbacks: the yarn length difference is likely to become less than 5%; the desired feeling is difficult to obtain, and the crimp ratio does not increase much when the textured yarn absorbs moisture.

The conjugate fiber for the above conjugate fiber-containing core-in-sheath composite false twist textured filament yarn can be produced by the method mentioned above. The filament yarn after the melt spinning step is preferably wound at a high rate without drawing heat treatment. When the spinning rate is from 1,000 to 4,500 m/min, preferred results are obtained. When the spinning rate is less than 1,000 m/min, the elongation at the break of the conjugate fiber thus obtained sometimes becomes excessive. On the other hand, when the spinning rate exceeds 4,500 m/min, the yarn breakage often takes place sometimes during yarn production.

For the above conjugate fiber-containing core-in-sheath composite false twist textured yarn, examples of the core yarn that can be used include a conjugate fiber formed from a polyester single component, a conjugate fiber formed from the same composition as the sheath filament yarn, a conjugate fiber formed from a poly(ethylene terephthalate) and a poly (trimethylene terephthalate), and the like. However, in view of cost, a polyester single component is preferred. Although a poly(ethylene terephthalate), a poly(trimethylene terephthalate), a poly(butylene terephthalate), or the like, can be used as the polyester, a poly(ethylene terephthalate) is preferred in view of the cost.

The total fiber thickness of the above composite false twist textured yarn used as a conventional clothing material is from 40 to 200 dtex, and an individual fiber thickness of the core filament yarn and sheath filament yarn is from 1 to 6 dtex.

A method of producing the above composite false twist textured yarn includes the steps of: paralleling the above-mentioned core filament yarn and the sheath filament yarn together; preferably air interlacing the paralleled yarn; and composite false twist texturing the interlaced yarn by using a known false twist texturing machine. A disc type or belt type false twist texturing machine can be used as the false twist texturing apparatus.

The above composite false twist textured yarn can naturally be singly used. The yarn can also be used in combination with another fiber by mixing or combining.

Combination of the composite false twist textured yarn with a natural fiber can naturally show more effects. Moreover, the stretchability may further be imparted by a combination of the composited yarn with a urethane or poly(trimethylene terephthalate).

The above composite false twist textured yarn can be used for various applications for clothing. For example, the textured yarn can particularly and preferably be used for such applications that require the prevention of see-through, and comfortableness such as windbreaking and warmth-retaining properties, in clothing such as various sportswear, underwear materials and uniforms.

The conjugate fiber-containing yarn of the present invention includes, as one embodiment, a conjugate fiber-containing false twist textured yarn that is obtained by false twist texturing the conjugate fiber-containing yarn and that increases the crimp ratio when it absorbs moisture or water.

The dry crimp ratio TDC of the conjugate fiber-containing false twist textured yarn obtained by subjecting the original false twist textured yarn to boiling water treatment for 30 minutes, subjecting the resultant yarn to dry heat treatment at 100° C. for 30 minutes under a load of $1.76\times10^{-3}$ CN/dtex, and further subjecting the resultant yarn to dry heat treatment at 160° C. for 1 minute under a load of $1.76\times10^{-3}$ CN/dtex, is from 5.0 to 23.7%, the wet crimp ratio THC of the conjugate fiber-containing false twist textured yarn, obtained after further immersing the conjugate fiber-containing false twist textured yarn in water at temperatures of 20 to 30° C. for 10 minutes is from 5.3 to 24%, and the crimp ratio difference ΔTC represented by the equation: ΔTC=THC−TDC is preferably from 0.3 to 8.0%.

The above conjugate fiber-containing false twist textured filament yarn has "non-see-through" properties even when the yarn is wetted with water, is excellent in windbreaking and warmth-retaining properties, and thus shows functional effects that have never been observed in conventional false twist textured yarns merely having feeling effects, such as bulkiness and stretchability.

It is important for the above conjugate fiber-containing false twist textured yarn to increase the crimp ratio when it absorbs moisture or water. The present inventors have found that a fabric prepared from a false twist textured yarn having such crimping properties does not become "see-through" even when the fabric is wetted with water, and that the stitches of the fabric are then clogged and the fabric has excellent windbreaking and warmth-retaining properties.

According to the examination of the present inventors, it has been found that the selection of the polymer structure, the polyester component, in particular, of the above conjugate fiber, makes the conjugate fiber have spinnability and false twist texturability that seem as if the conjugate fiber were a yarn formed from a polyamide component alone, although the fiber is formed from a polyester component and a polyamide component. That is, the polyester component is determined to be a modified polyester in which 5-sodiumsulfoisophthalic acid is copolymerized, and the modified polyester preferably has a suitable intrinsic viscosity. Specifically, the molecular cross-linking effect of 5-sodiumsulfoisophthalic acid increases the viscosity of the polyester component, and the polyester component rules the spinnability and false twist texturability. However, greatly lowering the intrinsic viscosity thereof makes the conjugate fiber have spinnability and false twistability that seem to belong to a yarn composed of the above polyamide component alone. The false twist textured yarn of the present invention that increases a crimp ratio when it absorbs moisture or water can thus be easily obtained. However, making the intrinsic viscosity of the polyester component too low is not preferred in view of industrial production and quality, because yarn productivity is lowered and fluffs are easily generated. Therefore, the above intrinsic viscosity is, as explained above, preferably from 0.30 to 0.43, more preferably from 0.35 to 0.41.

Furthermore, when the copolymerization amount of 5-sodiumsulfoisophthalic acid in the above modified polyester is too small, separation of the polyamide component and the polyester component unpreferably tends to take place at the conjugated boundary, although excellent crimping properties are obtained. Conversely, when the copolymerization amount of 5-sodiumsulfoisophthalic acid is excessive, crystallization of the polyester hardly proceeds during drawing heat treatment and false twist texturing steps. As a result, a false twist textured yarn having a high crimp ratio is hardly obtained. Raising the draw-heat treatment temperature and false twist texturing temperature for the purpose of promoting crystallization unpreferably causes many yarn breakages. The copolymerization amount of 5-sodiumsulfoisophthalic acid is therefore preferably from 2.0 to 4.5% by mole, more preferably from 2.3 to 3.5% by mole as explained above.

In addition, both components explained above may contain pigments such as titanium oxide and carbon black, known antioxidants, antistatic agents, light-resistant agents, and the like.

For the form of conjugation of the polyamide component and the polyester component in the above conjugate fiber, the form of conjugating both components in a side-by-side manner is preferred in view of manifesting crimps. The cross-sectional shape of the above conjugate fiber may be either circular or noncircular. A triangular cross section or a quadrangular cross section, for example, may be employed as the noncircular one. In addition, the presence of hollow portions within the cross section of the conjugate fiber does not matter.

When the above conjugate fiber-containing false twist textured filament yarn is subjected to the following treatments as explained above, it is preferred that the crimp ratio DC, crimp ratio HC after water immersion and the difference ΔC between the crimp ratios simultaneously satisfy requirements explained below: the filament yarn is boiling water treated for 30 minutes; the filament yarn is further subjected to a dry heat treatment at 100° C. for 30 minutes to manifest crimps; and the filament yarn is subjected to a dry heat treatment at 160° C. for 1 minute.

That is, the dry crimp ratio TDC is preferably from 5.0 to 23.7%, more preferably from 5.0 to 23%, still more preferably from 6.0 to 20%, further preferably from 7.0 to 15%. A crimp ratio TDC mentioned above of less than 5.0% is not preferred, because a fabric excellent in bulkiness cannot be obtained. On the other hand, a crimp ratio TDC mentioned above of greater than 23.7% is not preferred, because separation of the polyester component and the polyamide component at the boundary tends to take place during false twist texturing that imparts such a high crimp ratio.

The wet crimp ratio THC subsequent to water immersion is preferably from 5.3 to 24%, more preferably from 7.0 to 24%, still more preferably from 8.0 to 20%, further preferably from 9.0 to 18%. When the crimp ratio THC is less than 5.3%, the effects of preventing see-through, and the windbreaking and warmth-retaining properties unpreferably become unsatisfactory. On the other hand, when the crimp ratio THC exceeds 24%, the fabric significantly shrinks at the time of containing water, and the feeling becomes poor.

The difference ΔTC between the THC and TDC is preferably from 0.3 to 8.0%, more preferably from 0.5 to 7.0%, still more preferably from 0.8 to 6.0%, further preferably from 1.0 to 5.5%. When the ΔTC is less than 0.3%, the effect of increasing a crimp ratio after water immersion is insignificant, and a fabric that is hard to see-through when wet and that is excellent in windbreaking and warmth-retaining properties is difficult to obtain. On the other hand, when the ΔTC exceeds 8.0%, the fabric has a poor feeling at the time of containing water, because it significantly shrinks.

The above conjugate fiber-containing false twist textured yarn having a total fiber thickness of from 40 to 200 dtex and an individual fiber thickness of from 1 to 6 dtex can be used as a conventional clothing material. In addition, the yarn may be optionally interlaced.

Although the above conjugate fiber can be produced (by the above-mentioned method, the spinning rate is preferably as relatively high as from 2,000 to 4,000 m/min. A conjugate fiber filament yarn that can be easily false twist textured can then be obtained. A conventional false twist texturing apparatus can be used for the false twist texturing, and a conventional twisting apparatus, namely, a disc type or belt type twisting apparatus, can be used for the false twist texturing apparatus.

The above conjugate fiber-containing false twist textured filament yarn may be used singly, or doubled or combined with another fiber. That is, the conjugate fiber-containing false twist textured filament yarn may be used in combination with a natural fiber filament yarn Alternatively, it may be used in combination with a urethane filament yarn or a poly(trimethylene terephthalate) fiber to form a filament yarn or a fabric having stretchability.

The above conjugate fiber-containing false twist textured filament yarn can be used for various clothing applications. For example, when the filament yarn is used for sportswear, underwear materials, uniforms, and the like, they can effectively exhibit their moisture-proof properties, windbreaking and warmth-retaining properties and prevention of see-through when wet.

EXAMPLES

The present invention is further explained by making reference to the following examples.

The following measurements were made in the following examples and comparative examples.

(1) Intrinsic Viscosity of a Polyamide and a Polyester

The intrinsic viscosity of a polyamide was measured at 30° C. using m-cresol as a solvent. Moreover, the intrinsic viscosity of a polyester was measured at 35° C. using o-chlorophenol as a solvent.

(2) Spinnability

The criteria of the spinnability were as follows.

3: Yarn breakage takes place 0 to one time during continuous spinning for 10 hours, and the spinnability is good.

2: Yarn breakage takes place from 2 to 4 times during continuous spinning for 10 hours, and the spinnability is slightly poor.

1: Yarn breakage takes place 5 times or more during continuous spinning for 10 hours, and the spinnability is extremely poor.

(3) Resistance to Boundary Separation Between a Polyamide Component and a Polyester Component Twenty-four conjugate fibers were arbitrarily collected. Color photomicrographs with a magnification×1,070 of the cross sections of the fibers were taken, and the state of boundary separation between the polyamide component and the polyester component in the filaments was examined. The criteria of the boundary separation are as follows.

3: Substantially no boundary separation (0 to 1) is present.

2: Boundary separation is present in 2 to 10 filaments.

1: Boundary separation is present in substantially all filaments.

(4) Tensile Strength (cN/dtex), Elongation at Break (%)

A fiber sample was allowed to stand a day and a night in a thermo-hygrostat at a temperature of 25° C. and a RH of 60%. A test sample 100 mm long prepared from the fiber sample was then set at a Tensilon tensile tester (manufactured by Shimadzu Corporation), and the tensile strength and elongation at break of the test sample were determined by pulling the sample at a rate of 200 mm/min.

(5) Stress (cN/dtex) at 10% Elongation

The stress at 10% elongation was determined from the stress-elongation curve obtained in the above determination of the strength and elongation, and the value was divided by the thickness of the conjugate fiber to give the stress (cN/dtex) at 10% elongation.

(6) Dry Crimp Ratio DC, Wet Crimp Ratio HC after Water Immersion and Difference Therebetween ΔC (=(HC)−(DC))

A hank of 2,700 dtex was prepared from a conjugate fiber, and treated in boiling water for 30 minutes under a light load of 6 g (2.2 mg/dtex). The moisture of the hank was lightly removed with a filter paper sheet. The hank was then dried with dry heat at 100° C. for 30 minutes under a load of 6 g (2.2 mg/dtex) so that the moisture was removed. The hank was further heat treated with dry heat at 160° C. for 1 minute under a load of 6 g (2.2 mg/dtex) to give a sample for measurements.

(a) Dry Crimp Ratio DC (%)

A sample for measurements (hank) having been subjected to the above treatments was treated under a load of 6 g (2.2 mg/dtex) for 5 minutes. The hank was then taken out, and left under a further load of 600 g (total 606 g: 2.2 mg/dtex+220 mg/dtex) for 1 minute, and the hank length L0 was determined. The load of 600 g was then removed, and the hank was left under a load of 6 g (2.2 mg/dtex). The hank length L1 was then determined. A crimp ratio DC was determined from the following formula $$DC(\%)=L0-L1/L0=100$$

(b) Wet Crimp Ratio HC (%) after Water Immersion

The same hank as used for determining the crimp ratio DC was used. The hank was treated in water (room temperature) under a load of 6 g (2.2 mg/dtex) for 10 hours. Water in the hank was then wiped out with a filter paper sheet. The hank was then left under a further load of 600 g (total 606 g: 2.2 mg/dtex+220 mg/dtex) for 1 minute, and the hank length L2 was determined. The load of 600 g was then removed, and the hank was left under a load of 6 g (2.2 mg/dtex) for 1 minute.

The hank length L3 was then determined. A crimp ratio HC after water immersion was determined from the following formula $$HC(\%)=L2-L3/L2\times100$$

(c) ΔC (%)

The difference ΔC between the crimp ratio DC and the crimp ratio HC after water immersion mentioned above is determined from the following formula:

$$\Delta C(\%)=HC(\%)-DC(\%)$$

(7) Properties of a Sleeve Knitted Fabric

A conjugate fiber is sleeve knitted, and the sleeve knitted fabric was boil dyed with a cationic dye. The dyed fabric was washed with water, and set for 1 minute in a dry heat at 160° C. to give a sample for measurements. Water was dropped on the sleeve knitted fabric, and the states of the lower portion and the periphery of the water drop were examined with a side photograph (magnification of ×200) of the fabric. The bulge or shrinking state under waterdrops of the stitches and the see-through feel of the fabric were judged with the naked eye.

(a) Shrinking Degree of Stitches (Degree of Air Gap Narrowing)

The criteria of the shrinking degree are as follows.

3: Stitches significantly shrink with waterdrops (each air gap is narrowed).

2: No substantial change in stitches caused by waterdrops is observed (no substantial change in each air gap is observed).

1: Stitches are rather extended by waterdrops (each air gap is widened).

(b) Prevention of See-Through (Non-See-Through Feel)

The criteria are as follows.

3: "See-through" of waterdrop portions is weakened (non-see-through feel is strengthened).

2: No change in "see-through" caused by waterdrops is observed (non-see-through feel is not changed).

1: "See-through" is strengthened by waterdrops (non-see-through feel is weakened).

Example 1

A nylon 6 having an intrinsic viscosity [η] of 1.3 and a modified poly(ethylene terephthalate) that had an intrinsic viscosity [η] of 0.39 and in which 3.0% by mole of 5-sodiumsulfoisophthalic acid was copolymerized were each melted at 270° C. and 290° C., respectively, and extruded through a conjugate spinneret described in Japanese Unexamined Patent Publication (Kokai) No. 2000-144518 each in an extrusion rate of 11.7 g/min to form a side-by-side conjugate filament yarn. The resultant conjugate filament yarn was cooled and solidified, and a finish oil was imparted thereto. The conjugate filament yarn was then preheated with a first roller at 60° C. at a speed of 1,000 m/min, subsequently drawn and heat treated (draw ratio of 2.80) between second rollers at a speed of 2,800 in/min and heated at 130° C., and wound to give a conjugate fiber of 83 dtex 24 fil. The spinnability was extremely good, and no yarn breakage took place during continuous spinning for 10 hours.

For the conjugate spinneret described in Japanese Unexamined Patent Publication (Kokai) No. 2000-144518, the spinning orifices are formed from two circular arc-like slits A, B arranged on the substantially same circle with a space (d). The spinning orifices satisfy the following formulas (1) to (4) simultaneously:

$$B_1<A_1 \quad (1)$$

$$1.1\leqq SA/SB\leqq1.8 \quad (2)$$

$$0.4\leqq(SA+SB)/SC\leqq10.0 \quad (3)$$

$$d/A_1\leqq3.0 \quad (4)$$

wherein SA is an area of the circular arc-like slit A, $A_1$ is a slit width of the slit A, SB is an area of the circular arc-like slit B, B1 is a slit width of the slit B, and SC is an area surrounded by the inner periphery of the slits A, B.

The poly(ethylene terephthalate) was extruded from the side of the slit A, and the nylon 6 was extruded from the side of the slit B.

Examples 2 to 3

Comparative Example 1

Conjugate fiber filament yarns were obtained in the same manner as in Example 1, except that the second roller temperatures were altered as shown in Table 1. Table 1 shows the measurement results.

Examples 4 to 6

Comparative Examples 2 to 3

Conjugate fiber filament yarns were obtained in the same manner as in Example 1 except that the second roller speeds were altered as shown in Table 1. Table 1 shows the measurement results.

Examples 7 to 8

Comparative Example 4

Conjugate fiber filament yarns were obtained in the same manner as in Example 1 except that the second roller temperatures were altered as shown in Table 1. Table 1 shows the measurement results.

Examples 9 to 10

Comparative Examples 5 to 6

Conjugate fiber filament yarns were obtained in the same manner as in Example 1 except that copolymerization amounts of 5-sodiumsulfoisophthalic acid in the modified poly(ethylene terephthalate) were altered as shown in Table 1. Table 1 shows the measurement results.

Examples 11 to 12

Comparative Examples 7 to 8

Conjugate fiber filament yarns were obtained in the same manner as in Example 1 except that the intrinsic viscosities η of the modified poly(ethylene terephthalate) were altered as shown in Table 1. Table 1 shows the measurement results.

TABLE 1

| | Polyester component | | Spinning | | Drawing | | | Mechanical properties | | |
|---|---|---|---|---|---|---|---|---|---|---|
| | Coplymn. amt. (mol %) | I.V. [η] | Extrusion rate.* (g/min) | Spinnability | S.R. temp. (° C.) | S.R. speed (m/min) | Drawability | Stress (cN/dtex) | Elongation (%) | 10% Stress (cN/dtex) |
| Ex. 1 | 3.0 | 0.39 | 11.7 | 3 | 130 | 2800 | 3 | 3.0 | 50 | 1.6 |
| Ex. 2 | 3.0 | 0.39 | 11.7 | 3 | 150 | 2800 | 3 | 2.9 | 50 | 1.5 |
| Ex. 3 | 3.0 | 0.39 | 11.7 | 3 | 170 | 2800 | 3 | 2.1 | 26 | 1.4 |
| CE. 1 | 3.0 | 0.39 | 11.7 | 3 | 190 | 2800 | 1 | — | — | — |
| Ex. 4 | 3.0 | 0.39 | 10.8 | 3 | 130 | 2600 | 3 | 2.8 | 54 | 1.4 |
| Ex. 5 | 3.0 | 0.39 | 10.4 | 3 | 130 | 2500 | 3 | 2.6 | 60 | 1.2 |
| CE. 2 | 3.0 | 0.39 | 9.6 | 3 | 130 | 2300 | 1 | — | — | — |
| Ex. 6 | 3.0 | 0.39 | 12.5 | 3 | 130 | 3000 | 3 | 3.3 | 46 | 2.0 |
| CE. 3 | 3.0 | 0.39 | 13.8 | 3 | 130 | 3300 | 3 | 3.5 | 43 | 2.3 |
| Ex. 7 | 3.0 | 0.39 | 11.7 | 3 | 110 | 2800 | 3 | 3.1 | 52 | 1.5 |
| Ex. 8 | 3.0 | 0.39 | 11.7 | 3 | 90 | 2800 | 3 | 3.7 | 33 | 2.7 |
| CE. 4 | 3.0 | 0.39 | 11.7 | 3 | 70 | 2800 | 1 | — | — | — |
| Ex. 9 | 2.3 | 0.39 | 11.7 | 3 | 130 | 2800 | 3 | 3.2 | 54 | 1.8 |
| CE. 5 | 1.8 | 0.39 | 11.7 | 3 | 130 | 2800 | 3 | 3.4 | 56 | 2.0 |
| Ex. 10 | 4.4 | 0.39 | 11.7 | 3 | 130 | 2800 | 3 | 2.3 | 43 | 1.3 |
| CE. 6 | 4.7 | 0.39 | 11.7 | 1 | 130 | 2800 | — | — | — | — |
| Ex. 11 | 3.0 | 0.35 | 11.7 | 3 | 130 | 2800 | 3 | 2.8 | 46 | 1.5 |
| CE. 7 | 3.0 | 0.29 | 11.7 | 1 | 130 | 2800 | — | — | — | — |
| Ex. 12 | 3.0 | 0.42 | 11.7 | 3 | 130 | 2800 | 3 | 3.1 | 53 | 1.7 |
| CE. 8 | 3.0 | 0.45 | 11.7 | 1 | 130 | 2800 | — | — | — | — |

| | Boundary separation | Crimping properties | | | Shape change of sleeve knitted fabric | |
|---|---|---|---|---|---|---|
| | resistance | DC (%) | HC (%) | ΔC (%) | Prevention of widening of stitches | Prevention of see-through |
| Ex. 1 | 3 | 1.6 | 3.0 | 1.4 | 3 | 3 |
| Ex. 2 | 3 | 1.6 | 2.5 | 0.9 | 3 | 3 |
| Ex. 3 | 3 | 1.3 | 1.8 | 0.5 | — | — |
| CE. 1 | — | — | — | — | — | — |
| Ex. 4 | 3 | 1.3 | 4.0 | 2.7 | 3 | 3 |
| Ex. 5 | 3 | 1.2 | 6.5 | 5.3 | 3 | 3 |
| CE. 2 | — | — | — | — | — | — |
| Ex. 6 | 3 | 1.8 | 2.3 | 0.8 | 3 | 3 |
| CE. 3 | 3 | 4.3 | 2.3 | −2.0 | 1 | 1 |
| Ex. 7 | 3 | 1.4 | 3.8 | 2.4 | 3 | 3 |
| Ex. 8 | 3 | 0.8 | 5.3 | 3.5 | 3 | 3 |
| CE. 4 | — | — | — | — | — | — |
| Ex. 9 | 3 | 2.2 | 2.9 | 0.7 | 3 | 3 |
| CE. 5 | 1 | 4.5 | 3.5 | −1.0 | 1 | 1 |
| Ex. 10 | 3 | 0.3 | 1.5 | 1.2 | 3 | 3 |
| CE. 6 | — | — | — | — | — | — |
| Ex. 11 | 3 | 1.8 | 2.8 | 1.0 | 3 | 3 |
| CE. 7 | — | — | — | — | — | — |
| Ex. 12 | 3 | 1.0 | 1.9 | 0.8 | 3 | 3 |
| CE. 8 | — | — | — | — | — | — |

Note:
Coplymn. = Copolymerization
I.V. = Intrinsic viscosity
S.R. = Second roller

Example 13

A nylon 6 having an intrinsic viscosity [η] of 1.3 and a modified poly(ethylene terephthalate) that had an intrinsic viscosity [η] of 0.39 and in which 3.0% by mole of 5-sodiumsulfoisophthalic acid was copolymerized were each melted at 270° C. and 290° C., respectively, and extruded through a conjugate spinneret described in Japanese Unexamined Patent Publication (Kokai) No. 2000-144518 each in an extrusion rate of 16.9 g/min to form a side-by-side conjugate filament yarn. The resultant conjugate filament yarn was cooled and solidified, and a finish oil was imparted thereto. The conjugate filament yarn was then preheated with a first roller at room temperature at a speed of 1,800 m/min, subsequently drawn and heat treated (draw ratio of 1.69) between second rollers at 130° C. at a speed of 3,050 m/min, and wound to give a thick and thin conjugate fiber filament yarn of 110 dtex 24 fil. The spinnability and drawability were extremely good. No yarn breakage took place during continuous spinning for 10 hours. Table 2 shows the results.

Examples 14 to 17

Comparative Examples 9 to 10

Conjugate fiber filament yarns were obtained in the same manner as in Examples 13 except that the first roller speeds were altered as shown in Table 2. Table 2 shows the measurement results.

Examples 18 to 19

Comparative Example 11

Conjugate fiber filament yarns were obtained in the same manner as in Examples 13 except that the first roller temperatures were altered as shown in Table 2. Table 2 shows the measurement results.

Examples 20 to 21

Comparative Example 12

Conjugate fiber filament yarns were obtained in the same manner as in Examples 13 except that the second roller temperatures were altered as shown in Table 2. Table 2 shows the measurement results.

Examples 22 to 23

Comparative Examples 13 to 14

Conjugate fiber filament yarns were obtained in the same manner as in Examples 13 except that copolymerization amounts of 5-sodiumsulfoisophthalic acid in modified poly (ethylene terephthalate) components were altered as shown in Table 2. Table 2 shows the measurement results.

Examples 24 to 25

Comparative Examples 15 to 16

Conjugate fiber filament yarns were obtained in the same manner as in Examples 13 except that the intrinsic viscosities [η] of the modified poly(ethylene terephthalate) components were altered as shown in Table 2. Table 2 shows the measurement results.

Examples 26 to 27

Comparative Example 17

Conjugate fiber filament yarns were obtained in the same manner as in Examples 13 except that an extrusion rate of each component and the second roller speeds were altered as shown in Table 2. Table 2 shows the measurement results.

TABLE 2

| | Polyester component | | Spinning | | Drawing | | | | |
|---|---|---|---|---|---|---|---|---|---|
| | Copolymn. amt. (mol %) | I.V. [η] | Extrusion rate (g/min) | Spinnability | F.R. temp. (° C.) | S.R. temp. (° C.) | F.R. Speed (m/min) | S.R. speed (m/min) | Drawability |
| Ex. 13 | 3.0 | 0.39 | 16.9 | 3 | RT | 130 | 1800 | 3050 | 3 |
| Ex. 14 | 3.0 | 0.39 | 16.9 | 3 | RT | 130 | 2000 | 3050 | 3 |
| Ex. 15 | 3.0 | 0.39 | 16.9 | 3 | RT | 130 | 2200 | 3050 | 3 |
| Ex. 16 | 3.0 | 0.39 | 16.9 | 3 | RT | 130 | 2500 | 3050 | 3 |
| CE. 9 | 3.0 | 0.39 | 16.9 | 1 | RT | 130 | 2800 | 3050 | 1 |
| Ex. 17 | 3.0 | 0.39 | 16.9 | 3 | RT | 130 | 1500 | 3050 | 3 |
| CE. 10 | 3.0 | 0.39 | 16.9 | 3 | RT | 130 | 1000 | 3050 | 3 |
| Ex. 18 | 3.0 | 0.39 | 16.9 | 3 | 45 | 130 | 1800 | 3050 | 3 |
| Ex. 19 | 3.0 | 0.39 | 16.9 | 3 | 50 | 130 | 1800 | 3050 | 3 |
| CE. 11 | 3.0 | 0.39 | 16.9 | 3 | 60 | 130 | 1800 | 3050 | 3 |
| Ex. 20 | 3.0 | 0.39 | 16.9 | 3 | RT | 150 | 1800 | 3050 | 3 |
| Ex. 21 | 3.0 | 0.39 | 16.9 | 3 | RT | 170 | 1800 | 3050 | 3 |
| CE. 12 | 3.0 | 0.39 | 16.9 | 1 | RT | 190 | 1800 | 3050 | 1 |
| Ex. 22 | 2.3 | 0.39 | 16.9 | 3 | RT | 130 | 1800 | 3050 | 3 |
| CE. 13 | 1.8 | 0.39 | 16.9 | 3 | RT | 130 | 1800 | 3050 | 3 |
| Ex. 23 | 4.4 | 0.39 | 16.9 | 3 | RT | 130 | 1800 | 3050 | 3 |
| CE. 14 | 4.7 | 0.39 | 16.9 | 1 | RT | 130 | 1800 | 3050 | 1 |
| Ex. 24 | 3.0 | 0.33 | 16.9 | 3 | RT | 130 | 1800 | 3050 | 3 |
| CE. 15 | 3.0 | 0.29 | 16.9 | 1 | RT | 130 | 1800 | 3050 | 1 |
| EX. 25 | 3.0 | 0.41 | 16.9 | 3 | RT | 130 | 1800 | 3050 | 3 |
| CE. 16 | 3.0 | 0.48 | 16.9 | 3 | RT | 130 | 1800 | 3050 | 1 |
| Ex. 26 | 3.0 | 0.39 | 15.0 | 3 | RT | 130 | 1800 | 2700 | 3 |
| Ex. 27 | 3.0 | 0.39 | 13.9 | 3 | RT | 130 | 1800 | 2500 | 3 |
| CE. 17 | 3.0 | 0.39 | 12.8 | 1 | RT | 130 | 1800 | 2300 | — |

| | Phys. properties of conjugate fiber | | | | Crimping properties | | | Properties of sleeve knitted fabric | | |
|---|---|---|---|---|---|---|---|---|---|---|
| | Strength (cN/dtex) | Elongation (%) | U % | B.S.R. | DC (%) | HC (%) | ΔC (%) | Change of stitches | Prevention of see-through | Feeling |
| Ex. 13 | 1.3 | 58 | 13.5 | 3 | 7.0 | 9.4 | 2.4 | 3 | 3 | 2 |
| Ex. 14 | 1.3 | 74 | 10.9 | 3 | 6.9 | 9.7 | 2.8 | 3 | 3 | 2 |
| Ex. 15 | 1.2 | 86 | 8.7 | 3 | 6.9 | 9.2 | 2.3 | 3 | 3 | 2 |
| Ex. 16 | 1.1 | 93 | 6.5 | 3 | 5.2 | 10.8 | 5.5 | 3 | 3 | 2 |
| CE. 9 | — | — | — | — | — | — | — | — | — | — |
| Ex. 17 | 1.7 | 50 | 10.7 | 3 | 8.1 | 10.5 | 2.4 | 3 | 3 | 2 |
| CE. 10 | 2.0 | 41 | 2.1 | 3 | 12.5 | 10.5 | −2.0 | 3 | 1 | 1 |
| Ex. 18 | 1.6 | 60 | 10.3 | 3 | 8.3 | 9.0 | 0.7 | 3 | 3 | 2 |
| Ex. 19 | 1.8 | 62 | 7.5 | 3 | 8.5 | 8.9 | 0.4 | 3 | 3 | 2 |
| CE. 11 | 2.0 | 65 | 1.8 | 3 | 9.7 | 8.1 | −1.6 | 1 | 1 | 1 |
| Ex. 20 | 1.3 | 50 | 10.3 | 3 | 7.6 | 8.9 | 1.3 | 3 | 3 | 2 |
| Ex. 21 | 1.2 | 45 | 8.5 | 3 | 8.0 | 8.5 | 0.5 | 3 | 3 | 2 |

TABLE 2-continued

| | | | | | | | | | | |
|---|---|---|---|---|---|---|---|---|---|---|
| CE. 12 | — | — | — | — | — | — | — | — | — | — |
| Ex. 22 | 1.7 | 60 | 14.5 | 3 | 8.9 | 9.5 | 0.6 | 3 | 3 | 2 |
| CE. 13 | 2.0 | 65 | 14.5 | 1 | 12.3 | 10.5 | −1.8 | 1 | 1 | 1 |
| Ex. 23 | 1.2 | 39 | 6.5 | 3 | 14.5 | 5.5 | 1.0 | 3 | 3 | 2 |
| CE. 14 | — | — | — | — | — | — | — | — | — | — |
| Ex. 24 | 1.3 | 50 | 11.5 | 3 | 8.0 | 8.8 | 0.8 | 3 | 3 | 2 |
| CE. 15 | — | — | — | — | — | — | — | — | — | — |
| EX. 25 | 1.6 | 58 | 14.5 | 3 | 5.0 | 7.4 | 2.4 | 3 | 3 | 2 |
| CE. 16 | — | — | — | — | — | — | — | — | — | — |
| Ex. 26 | 1.5 | 65 | 14.5 | 3 | 6.5 | 9.8 | 3.3 | 3 | 3 | 2 |
| Ex. 27 | 1.3 | 72 | 14.9 | 3 | 5.5 | 8.8 | 3.3 | 3 | 3 | 2 |
| CE. 17 | — | — | — | — | — | — | — | — | — | — |

Note:
Copolymn. = Coplymerization
I.V. = Intrinsic viscosity
F.R. = First roller
S.R. = Second roller
B.S.R. = Boundary separation resistance In Table 2, U % and the feeling are evaluated by the following methods.

(8) U %

U % was measured under half inert conditions using an evenness tester (manufactured by Keisokki Kogyo K.K.).

(9) Feeling

A conjugate fiber was sleeve knitted, and the knitted fabric was boil dyed with a cationic dye. The dyed fabric was washed with water, and set in a dry heat at 160° C. for 1 minute to give a sample for measurements. The touch of the sample was evaluated as described below, and shown in a table.

2: The knitted fabric has a spun yarn-like feeling.

1: The knitted fabric is insufficient in a spun yarn-like feeling.

Example 28

A nylon 6 having an intrinsic viscosity [η] of 1.3 and a modified poly(ethylene terephthalate) that had an intrinsic viscosity [η] of 0.39 and in which 3.0% by mole of 5-sodiumsulfoisophthalic acid was copolymerized were each melted at 270° C. and 290° C., respectively, and extruded through a conjugate spinneret described in Japanese Unexamined Patent Publication (Kokai) No. 2000-144518 each in an extrusion rate of 11.7 g/min to form a side-by-side conjugate filament yarn. The resultant conjugate filament yarn was cooled and solidified, and a finish oil was imparted thereto. The conjugate filament yarn was then taken up at a rate of 1,000 m/min, preheated with a first roller at 60° C., subsequently drawn and heat treated (draw ratio of 2.80) between second rollers at 130° C. at a speed of 2,800 m/min, and wound to give a conjugate fiber of 83 dtex/24 filaments.

On the other hand, a poly(ethylene terephthalate) fiber to be used as a high shrinkage component was prepared by the following procedure. A poly(ethylene terephthalate) that had an intrinsic viscosity of 0.64, in which 10% by mole of isophthalic acid was copolymerized, and that contained 0.3% of titanium dioxide as a delustering agent was melted at 285° C., extruded in an extrusion rate of 12 g/min, and cooled and solidified. A finish oil was imparted to the extruded copolymer, and the extruded copolymer was wound at a spinning rate of 1,200 m/min to give an undrawn yarn of 100 dtex/12 fil. The undrawn yarn was drawn with a conventional drawing machine to give a poly(ethylene terephthalate) fiber that was high shrinkage filaments of 33 dtex/12 fil. The drawing conditions are described below.

(Drawing Conditions)

Drawing rate: 500 m/min

Draw ratio: 3.0

Drawing temperature: 80° C.

Set temperature: room temperature

The low shrinkage filaments and the high shrinkage filaments were doubled, and wound while being interlaced to give a combined yarn of 117 dtex/36 fil. The number of interlacing of the combined yarn was 43/m. Table 3 shows the measurement results.

Examples 29 to 33

Comparative Examples 19 to 21

Combined yarns were obtained in the same manner as in Example 28 except that the first roller temperatures were altered as shown in Table 3. Table 3 shows the measurement results.

Examples 34 to 38

Comparative Examples 18 and 22 to 24

Combined filament yarns were obtained in the same manner as in Example 28, except that the second roller speeds were altered as shown in Table 3. Table 3 shows the measurement results.

Examples 39 and 40

Comparative Examples 25 and 26

Combined filament yarns were obtained in the same manner as in Example 28 except that the copolymerization amounts of 5-sodiumsulfoisophthalic acid of the modified polyester component were altered as shown in Table 3. Table 3 shows the measurement results.

Examples 41 to 42

Comparative Examples 27 to 28

Combined filament yarns were obtained in the same manner as in Example 28, except that the intrinsic viscosities [η] were altered as shown in Table 3. Table 3 shows the measurement results.

TABLE 3

| | Low shrinkage filaments | | | | | | |
|---|---|---|---|---|---|---|---|
| | | | Spinning | | | | |
| | Copolymn. Amt. (mol %) | I.V. [η] | Extrusion rate (g/min) | F.R. speed (spinning rate) (m/min) | S.R. speed (m/min) | S.R. temp. (° C.) | Spinnability |
| Ex. 28 | 3.0 | 0.39 | 11.7 | 1000 | 2800 | 130 | 3 |
| CE. 18 | 3.0 | 0.39 | 12.7 | 1000 | 3050 | 150 | 3 |
| Ex. 29 | 3.0 | 0.39 | 11.7 | 1000 | 2800 | 120 | 3 |
| Ex. 30 | 3.0 | 0.39 | 11.7 | 1000 | 2800 | 110 | 3 |
| Ex. 31 | 3.0 | 0.39 | 11.7 | 1000 | 2800 | 100 | 3 |
| CE. 19 | 3.0 | 0.39 | 11.7 | 1000 | 2800 | 90 | 3 |
| Ex. 32 | 3.0 | 0.39 | 11.7 | 1000 | 2800 | 140 | 3 |
| Ex. 33 | 3.0 | 0.39 | 11.7 | 1000 | 2800 | 150 | 3 |
| CE. 20 | 3.0 | 0.39 | 11.7 | 1000 | 2800 | 160 | 3 |
| CE. 21 | 3.0 | 0.39 | 11.7 | 1000 | 2800 | 180 | 1 |
| Ex. 34 | 3.0 | 0.39 | 12.1 | 1000 | 2900 | 130 | 3 |
| Ex. 35 | 3.0 | 0.39 | 12.5 | 1000 | 3000 | 130 | 3 |
| Ex. 36 | 3.0 | 0.39 | 12.9 | 1000 | 3100 | 130 | 3 |
| CE. 22 | 3.0 | 0.39 | 13.8 | 1000 | 3300 | 130 | 3 |
| CE. 23 | 3.0 | 0.39 | 14.6 | 1000 | 3500 | 130 | 1 |
| Ex. 37 | 3.0 | 0.39 | 11.3 | 1000 | 2700 | 130 | 3 |
| Ex. 38 | 3.0 | 0.39 | 10.8 | 1000 | 2600 | 130 | 3 |
| CE. 24 | 3.0 | 0.39 | 10.4 | 1000 | 2500 | 130 | 1 |
| Ex. 39 | 2.3 | 0.39 | 11.7 | 1000 | 2800 | 130 | 3 |
| CE. 25 | 1.8 | 0.39 | 11.7 | 1000 | 2800 | 130 | 3 |
| Ex. 40 | 4.4 | 0.39 | 11.7 | 1000 | 2800 | 130 | 3 |
| CE. 26 | 4.7 | 0.39 | 11.7 | 1000 | 2800 | 130 | 1 |
| Ex. 41 | 3.0 | 0.35 | 11.7 | 1000 | 2800 | 130 | 3 |
| CE. 27 | 3.0 | 0.29 | 11.7 | 1000 | 2800 | 130 | 1 |
| Ex. 42 | 3.0 | 0.42 | 11.7 | 1000 | 2800 | 130 | 3 |
| CE. 28 | 3.0 | 0.47 | 11.7 | 1000 | 2800 | 130 | 1 |

| | Low shrinkage filament | | | | | High Shrinkage filament | Combined yarn | | | |
|---|---|---|---|---|---|---|---|---|---|---|
| | Shrinkage | | | | | Shrinkage | | Properties of sleeve knitted fabric | | |
| | BWSA (%) | B.S.R. | DC (%) | HC (%) | ΔC (%) | BWSB (%) | Shrinkage difference | Prevention of change in stitches | Prevention of see-through | Feeling |
| Ex. 28 | 15.0 | 3 | 1.6 | 3.0 | 1.4 | 39.5 | 24.5 | 2 | 2 | 2 |
| CE. 18 | 15.0 | 3 | 3.3 | 1.6 | −1.7 | 39.5 | 24.5 | 1 | 1 | 2 |
| Ex. 29 | 16.2 | 3 | 1.6 | 3.0 | 1.4 | 39.5 | 23.5 | 2 | 2 | 2 |
| Ex. 30 | 17.5 | 3 | 1.2 | 4.8 | 3.6 | 39.5 | 22.0 | 2 | 2 | 2 |
| Ex. 31 | 25.7 | 3 | 0.9 | 5.6 | 4.7 | 39.5 | 13.8 | 2 | 2 | 2 |
| CE. 19 | 35.3 | 3 | 0.4 | 6.7 | 5.3 | 39.5 | 4.2 | 2 | 2 | 1 |
| Ex. 32 | 14.2 | 3 | 1.9 | 2.8 | 0.9 | 39.5 | 25.3 | 2 | 2 | 2 |
| Ex. 33 | 13.7 | 3 | 2.1 | 2.6 | 0.5 | 39.5 | 25.8 | 2 | 2 | 2 |
| CE. 20 | 10.1 | 3 | 3.1 | 2.8 | −0.3 | 39.5 | 29.4 | 1 | 1 | 2 |
| CE. 21 | — | — | — | — | — | — | — | — | — | — |
| Ex. 34 | 16.1 | 3 | 1.7 | 2.7 | 1.0 | 39.5 | 23.4 | 2 | 2 | 2 |
| Ex. 35 | 17.8 | 3 | 3.0 | 3.8 | 0.8 | 39.5 | 21.7 | 2 | 2 | 1 |
| Ex. 36 | 18.5 | 3 | 4.1 | 4.6 | 0.5 | 39.5 | 21.0 | 2 | 2 | 2 |
| CE. 22 | 20.1 | 3 | 6.7 | 6.3 | −0.4 | 39.5 | 19.4 | 1 | 1 | 2 |
| CE. 23 | — | — | — | — | — | — | — | — | — | — |
| Ex. 37 | 16.1 | 3 | 1.1 | 2.6 | 1.5 | 39.5 | 23.4 | 2 | 2 | 2 |
| Ex. 38 | 18.3 | 3 | 0.9 | 1.9 | 1.0 | 39.5 | 21.2 | 2 | 2 | 2 |
| CE. 24 | — | — | — | — | — | — | — | — | — | — |
| Ex. 39 | 14.5 | 3 | 1.2 | 2.6 | 1.4 | 39.5 | 25.0 | 2 | 2 | 2 |
| CE. 25 | 12.6 | 1 | 1.1 | 2.2 | 1.1 | 39.5 | 26.9 | 2 | 2 | 1 |
| Ex. 40 | 16.7 | 3 | 1.8 | 3.1 | 1.3 | 39.5 | 22.8 | 2 | 2 | 2 |
| CE. 26 | — | — | — | — | — | — | — | — | — | — |
| Ex. 41 | 13.8 | 3 | 0.8 | 1.5 | 0.7 | 39.5 | 25.7 | 2 | 2 | 2 |
| CE. 27 | — | — | — | — | — | — | — | — | — | — |
| Ex. 42 | 16.0 | 3 | 1.9 | 3.5 | 1.5 | 39.5 | 23.0 | 2 | 2 | 2 |
| CE. 28 | — | — | — | — | — | — | — | — | — | — |

Note:
Copolymn. = Coplymerization
I.V. = Intrinsic viscosity
F.R. = First roller
S.R. = Second roller
B.S.R. = Boundary separation resistance The filament-combinability, the boiling water shrinkages of a high shrinkage fiber and a conjugate fiber, and the shape change, feeling and the number of interlacing of a sleeve knitted fabric in Table 3 were measured and evaluated by the following methods.

(10) Filament-Combinability

The criteria of the filament-combinability are as follows.

3: Yarn breakage takes place 0 to 1 time during continuous filament combining for 10 hours, and the spinnability is good.

2: Yarn breakage takes place 2 to 4 times during continuous filament combining for 10 hours, and yarn productivity is slightly poor.

1: Yarn breakage takes place 5 times or more during continuous filament combining for 10 hours, and yarn productivity is extremely poor.

(11) Shrinkage of a High Shrinkage Fiber and a Conjugate Fiber in Boiling Water

The shrinkage (BWSA) of a high shrinkage fiber in boiling water, and the shrinkage (BWSB) of a conjugate fiber in boiling water were each determined by the following procedure. A hank is prepared with a counter reel having a frame periphery of 1.125 m. The hank length (L4) is measured under a load of 27.7 cN/dtex. The load of the hank is removed, and the hank is treated in boiling water for 30 minutes. Water of the hank is wiped out, and the hank is left at room temperature for 1 hour. The hank length L5 is then measured, and the shrinkage is calculated from the following formula $$\text{shrinkage}(\%)=(L4-L5)/L4\times 100$$

(12) Change in the Shape of a Sleeve Knitted Fabric

A combined filament yarn was sleeve knitted, and the sleeve knitted fabric was boil dyed with a cationic dye. The dyed fabric was washed with water, and set for 1 minute in a dry heat at 160° C. to give a sample for measurements. Water was dropped on the sleeve knitted fabric, and the states of the lower portion and the periphery of the water drop were examined with a side photograph (magnification of ×200) of the fabric. The bulge or shrinkage state of the stitches and the see-through feel of the fabric produced under the waterdrops were judged with the naked eye.

(a) Change in Stitches

The criteria of the change in stitches are as follows.

2: Stitches significantly shrink under waterdrops (each air gap is narrowed).

1: Stitches extend under waterdrops (each air gap is widened).

(b) Non-See-Through Feel

The criteria are as follows.

2: The see-through feel is weakened under waterdrops, and the non-see-through feel is strengthened.

1: The see-through feel is strengthened under waterdrops (non-see-through feel is weakened).

(13) Feeling

A combined filament yarn was sleeve knitted, and the knitted fabric was boil dyed with a cationic dye. The dyed fabric was washed with water, and set in a dry heat at 160° C. for 1 minute to give a sample for measurements. The feeling of the sample was evaluated by touch. The criteria are as follows.

2: The knitted fabric has a bulge feel and is silky to the touch.

1: The knitted fabric has a stiff or paper-like feeling, and no bulge feel.

(14) Number of Interlacing

A combined filament yarn was placed in water, and the number of interlacing was counted with the naked eye, and the number thereof per meter was determined.

In addition, it was confirmed in Examples 28 to 42 that even for a combined filament yarn, the shrinkage of a low shrinkage filament was increased by moisture or water absorption and the stitches of a sleeve knitted fabric were clogged.

Example 43

A nylon 6 having an intrinsic viscosity [η] of 1.3 and a modified poly(ethylene terephthalate) that had an intrinsic viscosity [η] of 0.39 and in which 3.0% by mole of 5-sodiumsulfoisophthalic acid was copolymerized were each melted at 270° C. and 290° C., respectively, and extruded through a conjugate spinneret described in Japanese Unexamined Patent Publication (Kokai) No. 2000-144518 each in an extrusion rate of 8.3 g/min to form a side-by-side conjugate filament yarn. The resultant conjugate filament yarn was cooled and solidified, and a finish oil was imparted thereto. The conjugate filament yarn was then wound at a rate of 1,000 m/min to give an undrawn yarn of 167 dtex/24 filaments.

A poly(ethylene terephthalate) having an intrinsic viscosity [η] of 0.64 and containing 0.3% by weight of titanium oxide was melted at 300° C., extruded through a spinneret having 12 extrusion orifices each 0.30 mm in diameter in an extrusion rate of 40.3 g/min, and cooled and solidified. The solidified yarn was then wound at a spinning rate of 3,300 m/min to give an undrawn yarn of 122 dtex/12 fil. The undrawn yarn thus obtained had a strength of 2.5 cN/dtex and an elongation of 135%.

The above two types of undrawn yarns were doubled, and interlaced with air (interlacing (1L) treatment). The interlaced yarn was composite false twist textured under the following conditions using a friction type false twist texturing machine to give a composite false twist textured yarn of 186 dtex/36 fil. Table 4 shows the measurement results.

(False Twist Texturing Conditions)

False twist texturing rate: 300 m/min

False twist texturing ratio: 1.55

False twist texturing temperature: 140° C. (using a non-contact heater (effective length of 90 cm))

D/Y: 1.8

Interlacing treatment: OF: 0.5%, IL pressure: 2.0 kg/cm$^2$

Examples 44 to 48

Comparative Examples 29 to 31

Composite false twist textured yarns were obtained in the same manner as in Example 43 except that the composite false twist texturing (heater) temperatures were altered as shown in Table 4. Table 4 shows the measurement results.

Examples 49 to 54

Comparative Examples 32 to 34

Composite false twist textured yarns were obtained in the same manner as in Example 43, except that the spinning rates were altered as shown in Table 4. Table 4 shows the measurement results.

Examples 55 to 56

Comparative Examples 35 to 36

Composite false twist textured yarns were obtained in the same manner as in Example 43, except that the copolymerization amounts of 5-sodiumsulfoisophthalic acid of the modified polyester component were altered as shown in Table 4. Table 4 shows the measurement results.

Examples 57 to 58

Comparative Examples 37 to 38

Composite false twist textured yarns were obtained in the same manner as in Example 43, except that the intrinsic viscosities [η] of the modified polyester components were altered as shown in Table 4. Table 4 shows the measurement results.

It has been confirmed that in Examples 43 to 58, even for the composite false twist textured yarns, the sheath yarns increase their crimp ratios when they absorb moisture or water, similarly to the undrawn yarns.

TABLE 4

| | Composition of sheath yarn Polyester component | | Properties of undrawn yarn for sheath yarn | | | | | | | | |
|---|---|---|---|---|---|---|---|---|---|---|---|
| | | | Spinning | | | Mech. properties | | | | | |
| | Copolymn. amt. (mol %) | I.V. [η] | Extrusion rate (g/min) | Spinning rate (m/min) | Yarn productivity | Strength (cN/dtex) | Elongation (%) | Boundary separation | DC (%) | HC (%) | ΔC (%) |
| Ex. 43 | 3.0 | 0.39 | 8.3 | 1000 | 3 | 0.82 | 310 | 3 | 0.9 | 13.2 | 12.3 |
| Ex. 44 | 3.0 | 0.39 | 8.3 | 1000 | 3 | 0.82 | 310 | 3 | 0.9 | 13.2 | 12.3 |
| Ex. 45 | 3.0 | 0.39 | 8.3 | 1000 | 3 | 0.82 | 310 | 3 | 0.9 | 13.2 | 12.3 |
| CE. 29 | 3.0 | 0.39 | 8.3 | 1000 | 3 | 0.82 | 310 | 3 | 0.9 | 13.2 | 12.3 |
| Ex. 46 | 3.0 | 0.39 | 8.3 | 1000 | 3 | 0.82 | 310 | 3 | 0.9 | 13.2 | 12.3 |
| Ex. 47 | 3.0 | 0.39 | 8.3 | 1000 | 3 | 0.82 | 310 | 3 | 0.9 | 13.2 | 12.3 |
| Ex. 48 | 3.0 | 0.39 | 8.3 | 1000 | 3 | 0.82 | 310 | 3 | 0.9 | 13.2 | 12.3 |
| CE. 30 | 3.0 | 0.39 | 8.3 | 1000 | 3 | 0.82 | 310 | 3 | 0.9 | 13.2 | 12.3 |
| CE. 31 | 3.0 | 0.39 | 8.3 | 1000 | 3 | 0.82 | 310 | 3 | 0.9 | 13.2 | 12.3 |
| Ex. 49 | 3.0 | 0.39 | 12.5 | 1500 | 3 | 0.91 | 243 | 3 | 1.7 | 11.8 | 10.1 |
| Ex. 50 | 3.0 | 0.39 | 16.7 | 2000 | 3 | 1.08 | 191 | 3 | 2.3 | 10.3 | 8.0 |
| Ex. 51 | 3.0 | 0.39 | 25.0 | 3000 | 3 | 1.10 | 103 | 3 | 3.2 | 7.8 | 4.6 |
| Ex. 52 | 3.0 | 0.39 | 29.2 | 3500 | 3 | 1.15 | 82 | 3 | 4.3 | 6.2 | 1.9 |
| Ex. 53 | 3.0 | 0.39 | 33.3 | 4000 | 3 | 1.24 | 65 | 3 | 4.8 | 5.1 | 0.3 |
| CE. 32 | 3.0 | 0.39 | 35.8 | 4300 | 3 | 1.32 | 54 | 3 | 5.2 | 5.8 | −0.6 |
| CE. 33 | 3.0 | 0.39 | 37.5 | 4500 | 1 | — | — | — | — | — | — |
| Ex. 54 | 3.0 | 0.39 | 7.5 | 900 | 3 | 0.80 | 331 | 3 | 0.8 | 13.8 | 13.0 |
| CE. 34 | 3.0 | 0.39 | 6.7 | 800 | 3 | 0.75 | 353 | 3 | 0.7 | 14.5 | 13.8 |
| Ex. 55 | 2.3 | 0.39 | 8.3 | 1000 | 3 | 0.95 | 340 | 3 | 0.8 | 11.2 | 10.4 |
| CE. 35 | 1.8 | 0.39 | 8.3 | 1000 | 3 | 1.47 | 355 | 1 | 0.7 | 10.5 | 9.8 |
| Ex. 56 | 4.4 | 0.39 | 8.3 | 1000 | 3 | 0.89 | 280 | 3 | 0.7 | 13.5 | 12.8 |
| CE. 36 | 4.7 | 0.39 | 8.3 | 1000 | 1 | 0.87 | 121 | — | — | — | — |
| Ex. 57 | 3.0 | 0.35 | 8.3 | 1000 | 3 | 0.80 | 325 | 3 | 0.9 | 11.9 | 11.0 |
| CE. 37 | 3.0 | 0.29 | 8.3 | 1000 | 1 | — | — | — | — | — | — |
| Ex. 58 | 3.0 | 0.42 | 8.3 | 1000 | 3 | 1.08 | 308 | 3 | 1.2 | 9.9 | 8.7 |
| CE. 38 | 3.0 | 0.47 | 8.3 | 1000 | 1 | — | — | — | — | — | — |

| | Properties of composite false twist textured yarn | | | | | | | |
|---|---|---|---|---|---|---|---|---|
| | Texturing conditions and properties of textured yarn | | | | | Sleeve knitted fabric | | |
| | Texturing ratio | Texturing temp. (° C.) | Texturing properties | B.S.R. | Average yarn length difference (%) | Change in stitches | Non-see-through feel | Feeling |
| Ex. 43 | 1.55 | 125 | 3 | 3 | 17 | 2 | 2 | 2 |
| Ex. 44 | 1.55 | 110 | 3 | 3 | 18 | 2 | 2 | 2 |
| Ex. 45 | 1.55 | 100 | 3 | 3 | 18 | 2 | 2 | 2 |
| CE. 29 | 1.55 | 90 | 3 | 3 | 18 | 2 | 2 | 1 |
| Ex. 46 | 1.55 | 135 | 3 | 3 | 17 | 2 | 2 | 2 |
| Ex. 47 | 1.55 | 150 | 3 | 3 | 13 | 2 | 2 | 2 |
| Ex. 48 | 1.55 | 160 | 3 | 3 | 11 | 2 | 2 | 2 |
| CE. 30 | 1.55 | 180 | 1 | — | — | — | — | — |
| CE. 31 | 1.55 | 200 | 1 | — | — | — | — | — |
| Ex. 49 | 1.55 | 125 | 3 | 3 | 15 | 2 | 2 | 2 |
| Ex. 50 | 1.55 | 125 | 3 | 3 | 10 | 2 | 2 | 2 |
| Ex. 51 | 1.55 | 125 | 3 | 3 | 7.0 | 2 | 2 | 2 |
| Ex. 52 | 1.55 | 125 | 3 | 3 | 6.0 | 2 | 2 | 2 |
| Ex. 53 | 1.55 | 125 | 3 | 3 | 5.2 | 2 | 2 | 2 |
| CE. 32 | 1.55 | 125 | 3 | 3 | 3.5 | 1 | 1 | 1 |
| CE. 33 | — | — | — | — | — | — | — | — |
| Ex. 54 | 1.55 | 125 | 3 | 3 | 19 | 2 | 2 | 2 |
| CE. 34 | 1.55 | 125 | 3 | 3 | 22 | 2 | 2 | 1 |
| Ex. 55 | 1.55 | 125 | 3 | 3 | 18 | 2 | 2 | 2 |
| CE. 35 | 1.55 | 125 | 3 | 1 | 21 | 2 | 2 | 1 |
| Ex. 56 | 1.55 | 125 | 3 | 3 | 16 | 2 | 2 | 2 |
| CE. 36 | — | — | — | — | — | — | — | — |
| Ex. 57 | 1.55 | 125 | 3 | 3 | 18 | 2 | 2 | 2 |

TABLE 4-continued

| | | | | | | | | |
|---|---|---|---|---|---|---|---|---|
| CE. 37 | — | — | — | — | — | — | — | — |
| Ex. 58 | 1.55 | 125 | 3 | 3 | 19 | 2 | 2 | 2 |
| CE. 38 | — | — | — | — | — | — | — | — |

Note:
Copolymn. = Coplymerization
I.V. = Intrinsic viscosity
B.S.R. = Boundary separation resistance The composite false twist texturability, the filament length difference between the fiber filament yarn forming a core yarn and that forming a sheath yarn, and the shape change and feeling of a sleeve knitted fabric listed in Table 4 were measured and evaluated by the following methods.

(15) Composite False Twist Texturability

The criteria of the composite false twist texturability are as follows.

3: Yarn breakage takes place 0 to 1 time during continuous composite false twist texturing for 10 hours, and the yarn productivity is good.

2: Yarn breakage takes place from 2 to 4 times during continuous composite false twist texturing for 10 hours, and the yarn productivity is slightly poor.

1: Yarn breakage takes place 5 times or more during continuous composite false twist texturing for 10 hours, and the yarn productivity is extremely poor.

(16) Yarn Length Difference Between a Fiber Filament Yarn Forming a Core Yarn and a Fiber Filament Yarn Forming a Sheath Yarn A load a of 0.176 cN/dtex (0.2 g/de) is hooked to one end of a composite false twist textured yarn 50 cm long, and the yarn is vertically suspended. Marks are accurately made at 5 cm intervals on the yarn. The load is removed, and the marked portions are accurately cut to give 10 samples. One fiber (filament) is taken out of the sheath portion of each sample, and one fiber (filament) is taken out of the core portion thereof to give 10 individual filaments of the sheath portions and 10 individual filaments of the core portions. A load of 0.03 cN/dtex (1/30 g/de) is hooked to one end of each individual filament, and the filament is vertically suspended. The length of each filament is measured. The average value of the 10 filaments in the sheath portions is defined as a sheath portion yarn length and designated by La, and the average value of the 10 filaments in the core portions is defined as a core portion yarn length and designated by Lb. The yarn length difference is calculated from the following formula $$\text{yarn length difference}=(La-Lb)/La\times 100(\%)$$

(17) Change in the Shape of a Sleeve Knitted Fabric

A composite false twist textured yarn was sleeve knitted, and the sleeve knitted fabric was boil dyed with a cationic dye. The dyed fabric was washed with water, and set for 1 minute in a dry heat at 160° C. to give a sample for measurements. Water was dropped on the sleeve knitted fabric, and the states of the lower portion and the periphery of the water drop were examined with a side photograph (magnification, ×200) of the fabric. The bulge or shrinkage state of the stitches and the see-through feel of the fabric produced under the waterdrops were judged with the naked eye.

(a) Change in Stitches

The criteria of the change in stitches are as follows.

2: Stitches significantly shrink under waterdrops (each air gap is narrowed).

1: Stitches rather extend under waterdrops (each air gap is widened).

(b) Non-See-Through Feel

The criteria are as follows.

2: The see-through feel is weakened under waterdrops, and the non-see-through feel is strengthened.

1: The see-through feel is strengthened under waterdrops (non-see-through feel is weakened).

(18) Feeling

A composite false twist textured yarn was sleeve knitted, and the knitted fabric was boil dyed with a cationic dye. The dyed fabric was washed with water, and set in a dry heat at 160° C. for 1 minute to give a sample for measurements. The feeling of the sample was evaluated by the touch.

The criteria are as follows.

2: The knitted fabric has a spun yarn-like feeling and a bulge feel, and is soft.

1: The knitted fabric has no spun yarn-like feeling.

Example 59

A nylon 6 having an intrinsic viscosity [η] of 1.3 and a modified poly(ethylene terephthalate) that had an intrinsic viscosity [η] of 0.39 and in which 3.0% by mole of 5-sodiumsulfoisophthalic acid was copolymerized were each melted at 270° C. and 290° C., respectively, and extruded through a conjugate spinneret described in Japanese Unexamined Patent Publication (Kokai) No. 2000-144518 each at an extrusion rate of 11.7 g/min to form a side-by-side conjugate filament yarn. The resultant filament yarn was cooled and solidified, and a finish oil was imparted thereto. The yarn was then wound at a rate of 2,500 m/min to give an undrawn yarn of 110 dtex/24 filaments. The undrawn yarn thus obtained was further false twist textured under the following conditions using a friction type false twist texturing machine to give a false twist textured yarn of 72 dtex 24 fil. Table 5 shows the measurements results.

(False Twist Texturing Conditions)

False twist texturing rate: 300 m/min

False twist texturing ratio: 1.55

False twist texturing temperature: 140° C. (using a non-contact heater (effective length of 90 cm))

D/Y: 1.8

Examples 60 to 64

Comparative Examples 39 to 41

False twist textured yarns were obtained in the same manner as in Example 59, except that the false twist texturing (heater) temperatures were altered as shown in Table 5. Table 5 shows the measurement results.

Examples 65 to 69

Comparative Examples 42 to 45

False twist textured yarns were obtained in the same manner as in Example 59, except that the spinning rates and false twist texturing ratios were altered as shown in Table 5. Table 5 shows the measurement results.

Examples 70 to 72

Comparative Example 46

False twist textured yarns were obtained in the same manner as in Example 59, except that the copolymerization amounts of 5-sodiumsulfoisophthalic acid of the modified poly(ethylene terephthalate) were altered as shown in Table 5. Table 5 shows the measurement results.

Examples 73 to 74

Comparative Examples 47 to 48

False twist textured yarns were obtained in the same manner as in Example 59, except that the intrinsic viscosities [η] of the modified poly(ethylene terephthalate) were altered as shown in Table 5. Table 5 shows the measurement results.

TABLE 5

| | Composition Polyester component | | Properties of undrawn yarn | | | | | | | | |
|---|---|---|---|---|---|---|---|---|---|---|---|
| | | | Spinning | | | Mech. properties | | | | | |
| | Copolymn. amt. (mol %) | I.V. [η] | Extrusion rate (g/min) | Spinning rate (m/min) | Spinnability | Strength (cN/dtex) | Elongation (%) | B.S.R. | DC (%) | HC (%) | ΔC (%) |
| Ex. 59 | 3.0 | 0.39 | 13.9 | 2500 | 3 | 1.05 | 138 | 3 | 3.0 | 10.1 | 7.1 |
| Ex. 60 | 3.0 | 0.39 | 13.9 | 2500 | 3 | 1.05 | 138 | 3 | 3.0 | 10.1 | 7.1 |
| Ex. 61 | 3.0 | 0.39 | 13.9 | 2500 | 3 | 1.05 | 138 | 3 | 3.0 | 10.1 | 7.1 |
| Ex. 62 | 3.0 | 0.39 | 13.9 | 2500 | 3 | 1.05 | 138 | 3 | 3.0 | 10.1 | 7.1 |
| CE. 39 | 3.0 | 0.39 | 13.9 | 2500 | 3 | 1.05 | 138 | 3 | 3.0 | 10.1 | 7.1 |
| Ex. 63 | 3.0 | 0.39 | 13.9 | 2500 | 3 | 1.05 | 138 | 3 | 3.0 | 10.1 | 7.1 |
| Ex. 64 | 3.0 | 0.39 | 13.9 | 2500 | 3 | 1.05 | 138 | 3 | 3.0 | 10.1 | 7.1 |
| CE. 40 | 3.0 | 0.39 | 13.9 | 2500 | 3 | 1.05 | 138 | 3 | 3.0 | 10.1 | 7.1 |
| CE. 41 | 3.0 | 0.39 | 13.9 | 2500 | 3 | 1.05 | 138 | 3 | 3.0 | 10.1 | 7.1 |
| Ex. 65 | 3.0 | 0.39 | 13.5 | 2200 | 3 | 0.97 | 162 | 3 | 2.4 | 10.3 | 7.9 |
| Ex. 66 | 3.0 | 0.39 | 13.1 | 2000 | 3 | 0.88 | 180 | 3 | 2.2 | 10.9 | 3.7 |
| CE. 42 | 3.0 | 0.39 | 12.9 | 1800 | 3 | 0.80 | 205 | 3 | 1.9 | 11.5 | 9.6 |
| Ex. 67 | 3.0 | 0.39 | 14.2 | 2700 | 3 | 1.10 | 124 | 3 | 3.2 | 8.8 | 5.6 |
| Ex. 68 | 3.0 | 0.39 | 14.6 | 3000 | 3 | 1.14 | 107 | 3 | 3.6 | 7.8 | 4.2 |
| Ex. 69 | 3.0 | 0.39 | 14.9 | 3500 | 3 | 1.20 | 81 | 3 | 4.2 | 6.2 | 2.0 |
| CE. 43 | 3.0 | 0.39 | 15.2 | 4000 | 3 | 1.32 | 61 | 3 | 4.9 | 5.1 | 0.2 |
| CE. 44 | 3.0 | 0.39 | 15.4 | 4300 | 1 | — | — | — | — | — | — |
| CE. 45 | 3.0 | 0.39 | 15.6 | 4500 | 1 | — | — | — | — | — | — |
| Ex. 70 | 2.3 | 0.39 | 14.8 | 2500 | 3 | 1.35 | 152 | 3 | 2.9 | 7.5 | 4.6 |
| Ex. 71 | 1.8 | 0.39 | 16.0 | 2500 | 3 | 1.55 | 173 | 1 | 2.2 | 4.2 | 2.0 |
| Ex. 72 | 4.4 | 0.39 | 13.4 | 2500 | 3 | 1.03 | 128 | 3 | 3.7 | 10.6 | 6.9 |
| CE. 46 | 4.7 | 0.39 | 12.9 | 2500 | 1 | 0.87 | 121 | — | — | — | — |
| Ex. 73 | 3.0 | 0.35 | 13.3 | 2500 | 3 | 1.01 | 128 | 3 | 3.6 | 9.6 | 6.0 |
| CE. 47 | 3.0 | 0.29 | 13.3 | 2500 | 1 | — | — | — | — | — | — |
| Ex. 74 | 3.0 | 0.42 | 14.4 | 2500 | 3 | 1.08 | 144 | 3 | 4.3 | 9.9 | 5.6 |
| CE. 48 | 3.0 | 0.47 | 14.4 | 2500 | 1 | — | — | — | — | — | — |

| | Properties of false twist textured yarn | | | | | | | | | |
|---|---|---|---|---|---|---|---|---|---|---|
| | False twist textured yarn | | | | | | | Sleeve knitted fabric | | |
| | Texturing ratio | Texturing temp. (° C.) | Texturing properties | B.S.R. | DC (%) | HC (%) | ΔC (%) | Prevention of change in stitches | Prevention of see-through | Feeling |
| Ex. 59 | 1.55 | 140 | 3 | 3 | 15.8 | 21.0 | 5.2 | 2 | 2 | 2 |
| Ex. 60 | 1.55 | 120 | 3 | 3 | 13.5 | 20.4 | 6.6 | 2 | 2 | 2 |
| Ex. 61 | 1.55 | 110 | 3 | 3 | 10.3 | 14.4 | 4.1 | 2 | 2 | 2 |
| Ex. 62 | 1.55 | 100 | 3 | 3 | 6.7 | 9.0 | 2.3 | 2 | 2 | 2 |
| CE. 39 | 1.55 | 90 | 3 | 3 | 5.6 | 4.8 | −0.8 | 1 | 1 | 1 |
| Ex. 63 | 1.55 | 160 | 3 | 3 | 18.3 | 22.6 | 4.3 | 2 | 2 | 2 |
| Ex. 64 | 1.55 | 180 | 3 | 3 | 22.2 | 23.7 | 1.5 | 2 | 2 | 2 |
| CE. 40 | 1.55 | 200 | 1 | 1 | 27.6 | 25.5 | −2.1 | 1 | 1 | 1 |
| CE. 41 | 1.55 | 220 | 1 | 1 | 31.2 | 27.7 | −3.5 | 1 | 1 | 1 |
| Ex. 65 | 1.70 | 140 | 3 | 3 | 14.3 | 20.1 | 5.8 | 2 | 2 | 2 |
| Ex. 66 | 1.82 | 140 | 3 | 3 | 13.1 | 19.7 | 6.6 | 2 | 2 | 2 |
| CE. 42 | 1.98 | 140 | 1 | — | — | — | — | — | — | — |
| Ex. 67 | 1.46 | 140 | 3 | 3 | 16.8 | 21.5 | 4.7 | 2 | 2 | 2 |
| Ex. 68 | 1.35 | 140 | 3 | 3 | 18.5 | 21.5 | 3.1 | 2 | 2 | 2 |
| Ex. 69 | 1.16 | 140 | 3 | 3 | 19.7 | 21.5 | 1.6 | 2 | 2 | 2 |
| CE. 43 | 1.05 | 140 | 3 | 3 | 22.6 | 20.5 | −2.1 | 1 | 1 | 1 |
| CE. 44 | — | — | — | — | — | — | — | — | — | — |
| CE. 45 | — | — | — | — | — | — | — | — | — | — |
| Ex. 70 | 1.64 | 140 | 3 | 3 | 17.8 | 20.3 | 2.5 | 2 | 2 | 2 |
| Ex. 71 | 1.77 | 140 | 3 | 1 | 19.4 | 21.2 | 1.8 | 2 | 2 | 2 |
| Ex. 72 | 1.48 | 140 | 3 | 3 | 12.6 | 13.5 | 0.9 | 2 | 2 | 2 |

TABLE 5-continued

| | | | | | | | | | | |
|---|---|---|---|---|---|---|---|---|---|---|
| CE. 46 | — | — | — | — | — | — | — | — | — | — |
| Ex. 73 | 1.47 | 140 | 3 | 3 | 17.8 | 21.2 | 4.1 | 2 | 2 | 2 |
| CE. 47 | — | — | — | — | — | — | — | — | — | — |
| Ex. 74 | 1.59 | 140 | 3 | 3 | 17.5 | 21.0 | 3.5 | 2 | 2 | 2 |
| CE. 48 | — | — | — | — | — | — | — | — | — | — |

Note:
Copolymn. = Coplymerization
I.V. = Intrinsic viscosity
B.S.R. = Boundary separation resistance The false twist texturability, and the shape change and feeling of a sleeve knitted fabric were measured and evaluated by the following methods.

(19) False Twist Texturability

The criteria of the false twist texturability are as follows.

3: Yarn breakage takes place 0 to 1 time during continuous false twist texturing for 10 hours, and the yarn productivity is good.

2: Yarn breakage takes place from 2 to 4 times during continuous false twist texturing for 10 hours, and the yarn productivity is slightly poor.

1: Yarn breakage takes place 5 times or more during continuous composite false twist texturing for 10 hours, and the yarn productivity is extremely poor.

(20) Change in the Shape of a Sleeve Knitted Fabric

A false twist textured yarn was sleeve knitted, and the sleeve knitted fabric was boil dyed with a cationic dye. The dyed fabric was washed with water, and set for 1 minute in a dry heat at 160° C. to give a sample for measurements. Water was dropped on the sleeve knitted fabric, and the states of the lower portion and the periphery of the water drop were examined with a side photograph (magnification of ×200) of the fabric. The bulge or shrinkage state of the stitches and the see-through feel of the fabric produced under the waterdrops were judged with the naked eye.

(a) Change in Stitches

The criteria of the change in stitches are as follows.

2: Stitches significantly shrink under waterdrops (each air gap is narrowed).

1: Stitches rather extend under waterdrops (each air gap is widened).

(b) Non-See-Through Feel (See-Through Feel)

The criteria are as follows.

2: The see-through feel is weakened under waterdrops, and the non-see-through feel is strengthened.

1: The see-through feel is strengthened under waterdrops (non-see-through feel is weakened).

(21) Feeling

A false twist textured yarn was sleeve knitted, and the knitted fabric was boil dyed with a cationic dye. The dyed fabric was washed with water, and set in a dry heat at 160° C. for 1 minute to give a sample for measurements. The feeling of the sample was evaluated by the touch. The criteria are as follows.

2: The knitted fabric has a soft feeling and a bulge feel.

1: The knitted fabric has a paper-like feeling.

The false twist textured filament yarns in Examples 59 to 74 had good anti-see-through properties even when wetted with water, and showed a good feeling.

INDUSTRIAL APPLICABILITY

The conjugate fiber contained in the conjugate fiber-containing filament yarn of the present invention manifests crimps when heated, and the crimped conjugate fiber obtained from the conjugate fiber increases the crimp ratio when it absorbs moisture or water, and the crimps are recovered in a day due to drying. A fabric such as a woven or knitted fabric produced from a filament yarn (including a false twist textured yarn) containing such a conjugate fiber narrows air gaps in the fabric when wetted with water due to an increase in the crimp ratio of the conjugate fiber contained therein. The fabric has good anti-see-through properties, and good wind-breaking and warmth-retaining properties, and the properties are retained even after processing the fabric such as dye finishing. The conjugate fiber-containing filament yarn of the invention is therefore useful as a raw material for various fiber products, fiber products for clothing in particular.

The invention claimed is:

1. A conjugate fiber-containing yarn comprising a conjugate fiber in which a polyester component and a polyamide component are conjugated with each other in a side-by-side structure or an eccentric core-in-sheath structure, wherein (1) the polyester component comprises a modified polyester in which 5-sodiumsulfoisophthalic acid is copolymerized in an amount of from 2.0 to 4.5% by mole based on a total molecular amount of the acid component, and the intrinsic viscosity IV of the polyester component is from 0.30 to 0.43, and (2) the conjugate fiber is one produced from an undrawn conjugate fiber by a direct drawing procedure in which the undrawn conjugate fiber is directly drawn and heat set, without winding, by using a drawing machine having first and second rollers in which the conjugate fiber is preheated at a temperature of 50 to 100° C. by the first roller and heat-set at a temperature of 80 to 140° C. by the second roller, whereby the conjugate fiber is capable of manifesting crimps when heat treated, and the crimp ratio of the crimp-manifested conjugate fiber is increased by moisture or water absorption of the conjugate fiber.

2. The conjugate fiber-containing yarn according to claim 1, wherein the wet-dry crimp ratio difference ΔC of the conjugate fiber represented by the following formula is at least 0.3%

$$\Delta C(\%)=HC(\%)-DC(\%)$$

wherein DC is a dry crimp ratio obtained by subjecting a filament yarn composed of the conjugate fiber to a boiling water treatment for 30 minutes to manifest crimps, heat treating the treated yarn at 100° C. for 30 minutes under a load of $1.76\times10^{-3}$ CN/dtex to stabilize the crimps, heat treating the crimped conjugate fiber at 160° C. for 1 minute under a load of $1.76\times10^{-3}$ CN/dtex and measuring the crimp ratio, and HC is a wet crimp ratio obtained by immersing the crimped conjugate fiber having the dry crimp ratio DC in water at a temperature of from 20 to 30° C. for 10 hours, and measuring the crimp ratio.

3. The conjugate fiber-containing yarn according to claim 2, wherein the dry crimp ratio DC is from 0.2 to 6.7%, and the wet crimp ratio HC is from 0.5 to 7.0%.

4. The conjugate fiber-containing yarn according to claim 1, comprising thick and thin conjugate fibers in which thick portions and thin portions are alternately distributed along the longitudinal direction of each fiber.

5. The conjugate fiber-containing yarn according to claim 4, wherein the dry crimp ratio DC of the thick and thin conjugate fiber-containing yarn is from 4.0 to 12.8%, and the wet crimp ratio HC thereof is from 4.3 to 13.0%.

6. The conjugate fiber-containing filament yarn according to claim 4, wherein the evenness U % of the thick and thin conjugate fiber-containing yarn is from 2.5 to 15.0%.

7. The conjugate fiber-containing yarn according to claim 1, wherein a yarn formed from the conjugate fibers and a yarn formed from at least one type of fibers having a shrinkage in boiling water higher than that of the conjugate fibers are doubled and combined together and the conjugate fiber and the higher shrinkage fibers are mixed with each other.

8. The conjugate fiber-containing yarn according to claim 7, wherein the shrinkage in boiling water (BWSB) of the yarn formed from the conjugate fibers is from 12 to 30%, the shrinkage in boiling water (BWSA) of the higher shrinkage fiber yarn is 40% or less, and the difference between both the shrinkages (BWSA) and (BWSB) is from 10 to 26%.

* * * * *